US007337987B2

(12) United States Patent
Nishi et al.

(10) Patent No.: US 7,337,987 B2
(45) **Date of Patent: *Mar. 4, 2008**

(54) LIQUID JETTING DEVICE

(75) Inventors: Yasuo Nishi, Hino (JP); Kaoru Higuchi, Tenri (JP); Kazuhiro Murata, Tsukuba (JP); Hiroshi Yokoyama, Tsukuba (JP)

(73) Assignee: Konica Minolta Holdings, Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/529,004

(22) PCT Filed: Sep. 22, 2003

(86) PCT No.: PCT/JP03/12100

§ 371 (c)(1),
(2), (4) Date: Mar. 24, 2005

(87) PCT Pub. No.: WO2004/028814

PCT Pub. Date: Apr. 8, 2004

(65) Prior Publication Data

US 2006/0043212 A1 Mar. 2, 2006

(30) Foreign Application Priority Data

Sep. 24, 2002 (JP) ..... 2002-278232
Aug. 13, 2003 (JP) ..... 2003-293055

(51) Int. Cl.
*B05B 1/08* (2006.01)

(52) U.S. Cl. ..... 239/102.1; 239/690; 239/690.1; 239/696; 239/699; 239/102.2; 239/589; 239/596; 239/601; 239/708; 347/55; 347/68

(58) Field of Classification Search ..... 239/589, 239/596, 601, 708, DIG. 19, 690, 67, 68, 239/102.1, 102.2, 425, 696, 699, 690.1; 347/55, 347/68

See application file for complete search history.

(56) References Cited

U.S. PATENT DOCUMENTS 3,060,429 A * 10/1962 Winston ..... 346/11
3,886,565 A * 5/1975 Kojima ..... 347/47
4,717,926 A * 1/1988 Hotomi ..... 347/55
5,165,601 A * 11/1992 Rodenberger et al. ..... 239/690

(Continued)

FOREIGN PATENT DOCUMENTS

JP 4-59255 2/1992

(Continued)

*Primary Examiner*—Kevin Shaver
*Assistant Examiner*—Jason Boeckmann
(74) *Attorney, Agent, or Firm*—Cantor Colburn LLP

(57) ABSTRACT

A liquid jetting apparatus (50) to jet a droplet of a charged liquid solution onto a base material, having: a nozzle (51) in which an edge portion thereof is arranged to face the base material K having a receiving surface to receive the jetted droplet, and an inside diameter of the edge portion from which the droplet is jetted is not more than 30 [μm]; and a liquid solution supplying section (35) to supply the liquid solution into the nozzle (51), wherein a jetting electrode (58) of the jetting voltage applying section (35) is provided on a back end portion side of the nozzle, and an inside passage length of the nozzle is set to at least not less than ten times of the inside diameter.

10 Claims, 20 Drawing Sheets

U.S. PATENT DOCUMENTS

| | | | | |
|---|---|---|---|---|
| 6,412,925 | B1 * | 7/2002 | Takahashi | 347/69 |
| 6,481,648 | B1 * | 11/2002 | Zimmermann | 239/690 |
| 6,811,090 | B2 * | 11/2004 | Yogi et al. | 239/4 |
| 2003/0178507 | A1 * | 9/2003 | Maria Rijn Van | 239/337 |

FOREIGN PATENT DOCUMENTS

| | | | |
|---|---|---|---|
| JP | 8-252918 | | 10/1996 |
| JP | 2000-6423 | | 1/2000 |
| JP | 2000-15817 | | 1/2000 |
| JP | 2001-137758 | | 5/2001 |
| JP | 2002-154211 | | 5/2002 |
| JP | 2002-172787 | | 6/2002 |
| WO | WO 02/18058 | A1 * | 3/2002 |

* cited by examiner

FIG.7

| NOZZLE DIAMETER (μm) | MAXIMUM ELECTRIC FIELD INTENSITY(V/m) | | COEFFICIENT OF FLUCTUATION (%) |
|---|---|---|---|
| | GAP100 (μm) | GAP2000 (μm) | |
| 0.2 | $2.001 \times 10^9$ | $2.00005 \times 10^9$ | 0.05 |
| 0.4 | $1.001 \times 10^9$ | $1.00005 \times 10^9$ | 0.09 |
| 1 | $0.401002 \times 10^9$ | $0.40005 \times 10^9$ | 0.24 |
| 8 | $0.0510196 \times 10^9$ | $0.05005 \times 10^9$ | 1.94 |
| 20 | $0.0210476 \times 10^9$ | $0.0200501 \times 10^9$ | 4.98 |
| 50 | $0.00911111 \times 10^9$ | $0.00805 \times 10^9$ | 13.18 |

FIG.17

| No. | $D_I$(μm) | $D_O$(μm) | $D_{max}$(μm) | H(μm) | EVENNESS |
|---|---|---|---|---|---|
| 1 | 1 | 2 | 5 | 1 | 1 |
| 2 | 1 | 2 | 5 | 9 | 2 |
| 3 | 1 | 2 | 5 | 10 | 3 |
| 4 | 1 | 2 | 5 | 49 | 3 |
| 5 | 1 | 2 | 5 | 50 | 4 |
| 6 | 1 | 2 | 5 | 51 | 4 |
| 7 | 1 | 2 | 5 | 99 | 4 |
| 8 | 1 | 2 | 5 | 100 | 5 |

FIG.18

| No. | $D_I$(μm) | t(μm) | WATER REPELLENT PROCESSING | ANGLE OF NOZZLE EDGE SHAPE | RESPONSIVENESS |
|---|---|---|---|---|---|
| 1 | 1 | 2 | UNAVAILABLE | 90 | 1 |
| 2 | 1 | 1 | UNAVAILABLE | 90 | 3 |
| 3 | 1 | 0.2 | UNAVAILABLE | 90 | 3.5 |
| 4 | 1 | 1 | ① | 90 | 3.5 |
| 5 | 1 | 0.2 | ② | 90 | 4.0 |
| 6 | 1 | 2 | ② | 90 | 2 |
| 7 | 1 | 1 | ② | 40 | 4.0 |
| 8 | 1 | 0.2 | ② | 40 | 5.0 |
| 9 | 1 | 0.2 | ② | 20 | 3.0 |

LIQUID JETTING DEVICE

CROSS REFERENCE TO RELATED APPLICATION

This is a U.S. national stage of application No. PCT/JP2003/012100, filed on 22 Sep. 2003. Priority under 35 U.S.C. §119(a) and 35 U.S.C. §365(b) is claimed from Japanese Application No. 2002-278232, filed 24 Sep. 2002 and Japanese Application No. 2003-293055, filed 13 Aug. 2003, the disclosures of which are also incorporated herein by reference.

FIELD OF THE INVENTION

The present invention relates to a liquid jetting apparatus for jetting liquid to a base material.

BACKGROUND ART

As a conventional inkjet recording method, a piezo method for jetting an ink droplet by changing a shape of an ink passage according to vibration of a piezoelectric element, and a thermal method for making a heat generator provided in an ink passage heat to generate air bubbles and jetting an ink droplet according to a pressure change by the air bubbles in the ink passage are known, however, recently, an electrostatic sucking method for charging ink in an ink passage to jet an ink droplet by a electrostatic sucking force of the ink such as one described in JP-Tokukaihei-11-277747 or JP-Tokukai-2000-127410 has been increasing.

However, the above-mentioned inkjet recording method has the following problems.

(1) Limit and Stability of a Minute Liquid Droplet Formation

Since a nozzle diameter is large, a shape of a droplet jetted from a nozzle is not stabilized, and there is a limit of making a droplet minute.

(2) High Applying Voltage

For jetting a minute droplet, miniaturization of a jet opening of the nozzle is an important factor. In a principle of the conventional electrostatic sucking method, since the nozzle diameter is large, electric field intensity of a nozzle edge portion is weak, and therefore, in order to obtain necessary electric field intensity for jetting a droplet, it is necessary to apply a high jetting voltage (for example, extremely high voltage near 2000[V]). Accordingly, in order to apply a high voltage, a driving control of a voltage becomes expensive.

Thereupon, to provide a liquid jetting apparatus capable of jetting a minute droplet is a first object. At the same time, to provide a liquid jetting apparatus capable of jetting a stable droplet is a second object. Further, to provide a liquid jetting apparatus in which it is possible to jet a minute droplet and landing accuracy is high is a third object. Further, to provide a liquid jetting apparatus which can reduce an applying voltage and is cheap is a fourth object.

DISCLOSURE OF THE INVENTION

The present invention has a structure in which the liquid jetting apparatus to jet a droplet of a charged liquid solution onto a base material, comprises:

a liquid jetting head comprising a nozzle to jet the droplet from an edge portion, an inside diameter of the edge portion of the nozzle being not more than 30 [μm];

a liquid solution supplying section to supply the liquid solution into the nozzle; and a jetting voltage applying section to apply a jetting voltage to the liquid solution in the nozzle, wherein an inside passage length of the nozzle is set to at least not less than ten times of the inside diameter of the nozzle at the nozzle edge portion.

Hereinafter, the nozzle diameter indicates the inside diameter of the nozzle at the edge portion from which a droplet is jetted (inside diameter at the edge portion of the nozzle). A shape of cross section of a droplet jetting hole in the nozzle is not limited to a round shape. For example, in the case where the cross-sectional shape of the liquid jetting hole is a polygon shape, a star-like shape or other shape, it indicates that the circumcircle of the cross-sectional shape is not more than 30 [μm]. Hereinafter, regarding to the nozzle diameter or the inside diameter at the edge portion of the nozzle, it is to be the same even when other numerical limitations are given. The nozzle radius indicates the length of ½ of the nozzle diameter (inside diameter of the edge portion of the nozzle).

In the present invention, "base material" indicates an object to receive landing of a droplet of the liquid solution jetted, and material thereof is not specifically limited. Accordingly, for example, when applying the above structure to the ink jet printer, a recording medium such as a paper, a sheet or the like corresponds to the base material, and when forming a circuit by using a conductive paste, the base on which the circuit is to be made corresponds to the base material.

In the above structure, the nozzle or the base material is arranged so that a receiving surface where a droplet lands faces the edge portion of the nozzle. The arranging operation to realize the positional relation with each other may be performed by moving either the nozzle or the base material.

Then, the liquid solution is supplied to the inside of the liquid jetting head by the liquid solution supplying section. The liquid solution in the nozzle needs to be in a state of being charged for performing jetting. An electrode exclusively for charging may be provided to apply a voltage needed to charge the liquid solution.

The liquid solution is charged in the nozzle, so that the electric field intensity is concentrated. The liquid solution receives an electrostatic force toward the nozzle edge portion side, so that a state where the liquid solution protrudes at the nozzle edge portion (convex meniscus) is formed. When the electrostatic pressure exceeds a surface tension at the convex meniscus, a droplet of the liquid solution flies from the protruding edge portion of the convex meniscus in a direction perpendicular to the receiving surface of the base material, thereby forming a dot of the liquid solution on the receiving surface of the base material.

In the above structure, attempt is made to super miniaturize the nozzle diameter to obtain the effect of electric field concentration, however, for the liquid solution to obtain further intense electric field intensity at the nozzle edge portion, a droplet to be in a charged state is preferably elongated. Therefore, the inside passage length of the nozzle may be set to long. Based on this view, after considering the results of a relation between the inside passage length of the nozzle and responsiveness by a comparative study, the result was obtained, in which responsiveness is improved when the inside passage length of the nozzle is set to ten times of the inside diameter of the nozzle. That is, by setting the inside passage length of the nozzle to not less than ten times of the inside diameter of the nozzle, responsiveness of jetting at the miniaturized nozzle can be improved.

Preferably, the passage length of the in-nozzle passage is longer, however, it is preferable to choose a value (multiplication factor to the inside diameter) in consideration of difficulty of manufacturing, decrease of jetting stability by clogging or the like. As one example, the upper limit is set to around 150 times.

Here, the inside passage length of the nozzle indicates a distance H from a nozzle plate surface to the nozzle edge in a case of a liquid jetting head having a nozzle arranged on the nozzle plate (refer to FIG. 12).

Further, in the present invention, the electric field intensity becomes high by concentrating the electric filed at the nozzle edge portion with the use of the nozzle having a super minute diameter which cannot be found conventionally, and at that time, an electrostatic force which is generated between the distance to an image charge on the base material side is induced, thereby a droplet flies.

Accordingly, jetting a droplet can be performed with a lower voltage than that which has been conventionally considered, even with the minute nozzle, and can be favorably performed even when the base material is made of conductive material or insulating material.

In this case, jetting a droplet can be performed even when there is no counter electrode facing the edge portion of the nozzle. For example, in the case that the base material is arranged to face the nozzle edge portion in the state were there is no counter electrode, when the base material is a conductor, an image charge with reversed polarity is induced at a position which is plane symmetric with the nozzle edge portion with respect to the receiving surface of the base material as a standard, and when the base material is an insulator, an image charge with reversed polarity is induced at a symmetric position which is defined by dielectric constant of the base material with respect to the receiving surface of the base material as a standard. Flying of a droplet is performed by an electrostatic force between the electric charge induced at the nozzle edge portion and the image charge.

Thereby, the number of components in the structure of the apparatus can be reduced. Accordingly, when applying the present invention to a business ink jet system, in can contribute to improvement of productivity of the whole system, and also the cost can be reduced.

However, although the structure of the present invention can eliminate the use of a counter electrode, the counter electrode may be used at the same time. When the counter electrode is used at the same time, preferably, the base material is arranged to be along the facing surface of the counter electrode and the facing surface of the counter electrode is arranged to be perpendicular to a direction of jetting a droplet from the nozzle, thereby it becomes possible to use an electrostatic force by the electric field between the nozzle and the counter electrode for inducing a flying electrode. Moreover, by grounding the counter electrode, an electric charge of a charged droplet can be released via the counter electrode in addition to discharging the electric charge to the air, so that the effect to reduce storage of electric charges can also be obtained. Thus, using the counter electrode at the same time can be described as a preferable structure.

In addition to the above structure, the inside passage length of the nozzle may be set to at least not less than 50 times of the inside diameter of the nozzle at the nozzle edge portion.

In this structure, by setting the inside passage length of the nozzle to at least not less than 50 times of the inside diameter, responsiveness can be improved and the electric field can be concentrated more effectively, enabling to jet a more minute droplet.

Moreover, in addition to the above structure, the inside passage length of the nozzle may be set to at least not less than 100 times of the inside diameter of the nozzle at the nozzle edge portion.

In this structure, by setting the inside passage length of the nozzle to at least not less than 100 times of the inside diameter, responsiveness can be improved and a jetted droplet can be minute, and also the electric field can be concentrated more effectively, thereby enabling to stably concentrate the jetting position.

Moreover, in addition to the above structure, a wall thickness of the nozzle at the edge portion of the nozzle may be set to not more than a length equal to the inside diameter of the nozzle at the nozzle edge portion.

Thereby, an outside diameter of an edge surface of the nozzle can be set to not more than three times of the inside diameter, so that an area of the edge surface can be small, and the size of the edge surface can be defined with the inside diameter of the nozzle as a standard. Thus, the outside diameter of the nozzle edge can be defined according to the miniaturization of the inside diameter of the nozzle. As a result, the outside diameter of the convex meniscus which is formed at the nozzle edge portion and protrudes to a jetting direction can be miniaturized according to the nozzle inside diameter, so that jetting operation by a concentrated electric field is concentrated to the meniscus edge portion more effectively. Thus, responsiveness can be improved and a droplet can be minute.

Moreover, the wall thickness of the nozzle at the edge portion of the nozzle may be set to not more than ¼ of the length equal to the inside diameter of the nozzle at the nozzle edge portion.

Thereby, the outside diameter of the edge surface of the nozzle can be set to not more than 1.5 times of the inside diameter, so that the area of the edge surface can be smaller, and the size of the edge surface can be defined with the inside diameter of the nozzle as a standard. Thus, the outside diameter of the nozzle edge can be defined according to the miniaturization of the inside diameter of the nozzle. As a result, the outside diameter of the convex meniscus which is formed at the nozzle edge portion and protrudes to the jetting direction can be miniaturized according to the nozzle inside diameter, so that jetting operation by the concentrated electric field is concentrated to the meniscus edge portion more effectively. Thus, responsiveness can be further improved and a droplet can be further minute.

Moreover, at least the edge portion of a surface of the nozzle may be subjected to a water repellent processing.

Thereby, the convex meniscus according to the inside diameter of the nozzle can be formed, and the meniscus which is convex toward the jetting side can be formed more stably due to water repellency around the jetting hole at the nozzle edge, so that the jetting operation by the concentrated electric field is concentrated to the meniscus edge portion more effectively. Thus, responsiveness can be further improved and a droplet can be further minute.

Moreover, the edge surface of the nozzle may comprise an inclined surface with respect to a centerline of the in-nozzle passage.

Thereby, the liquid solution can be concentrated on a side of the jetting edge portion with a sharp shape formed by the inclined surface and the side surface of the nozzle, so that the jetting operation by the concentrated electric field is concentrated to the meniscus edge portion more effectively. Thus, responsiveness can be further improved and a droplet can be further minute.

Moreover, in addition to the above structure, an inclination angle of the edge surface of the nozzle may be in a range of 30 to 45 degrees.

The above "inclination angle" indicates an angle defined based on a standard in which the state where a normal line of the inclined surface accords to the centerline of the in-nozzle passage is defined as 90 degrees.

Considering only to concentrate the liquid solution to the edge portion of the inclined surface, it is preferable that the edge surface is more inclined to a direction that the edge portion is sharpened, however, when this angle is too small, discharge from the edge portion easily occurs, so that adversely, it may undermine the effect of the electric field concentration. Thus, to avoid such a thing, the inclination angle of the inclined surface is set to be in the range of 30 to 45 degrees, so that responsiveness can be further improved and a droplet can be further minute without undermining the effect of electric field concentration.

Moreover, in addition to the above described structure, the nozzle diameter may be less than 20 [μm].

Thereby, electric field intensity distribution becomes narrow. Therefore, the electric field can be concentrated. This results in making a droplet formed minute and stabilizing the shape thereof, and reducing the total applying voltage. The droplet is accelerated by an electrostatic force acting between the electric field and the charge just after jetted from the nozzle. However, the electric field rapidly decreases as the droplet moves away from the nozzle. Thus, thereafter, the droplet decreases the speed by air resistance. However, the minute droplet with concentrated electric field is accelerated as it approaches the counter electrode by an image force. By balancing the deceleration by air resistance and the acceleration by the image force, the minute droplet can stably fly and landing accuracy can be improved.

Moreover, the inside diameter of the nozzle may be not more than 10 [μm].

Thereby, the electric field can further be concentrated, so that a droplet can further be made minute and the effect to the electric field intensity distribution by the distance change to the counter electrode when flying can be reduced. This results in reducing the effects to the droplet shape or the landing accuracy by the positional accuracy of the counter electrode or, the property or the thickness of the base material.

Moreover, the inside diameter of the nozzle may be not more than 8 [μm].

Thereby, the electric field can further be concentrated, so that a droplet can further be made minute and the effect to the electric field intensity distribution by the distance change to the counter electrode when flying can be reduced. This results in reducing the effects to the droplet shape or the landing accuracy by the positional accuracy of the counter electrode or, the property or the thickness of the base material.

Further, with the degree of the electric field concentration becomes high, the effect of electric field crosstalk which is a problem when arranging nozzles in high density at the time of using a plurality of nozzles is reduced, enabling to arrange the nozzles with further high density.

Moreover, the inside diameter of the nozzle may be not more than 4 [μm]. With this structure, the electric field can significantly be concentrated, making maximum electric field intensity high, and a droplet can be minute with a stable shape and the initial speed of the droplet can be increased. Thereby, flying stability improves, resulting in further improving the landing accuracy and jetting responsiveness.

Further, with the degree of the electric field concentration becomes high, the effect of electric field crosstalk which is a problem when arranging nozzles with high density at the time of using a plurality of nozzles is reduced, enabling to arrange the nozzles with further high density.

Moreover, the inside diameter of the nozzle is preferably more than 0.2 [μm]. By making the inside diameter of the nozzle be more than 0.2 [μm], charging efficiency of a droplet can be improved. Thus, jetting stability can be improved.

Moreover, a jetting electrode of the jetting voltage applying section may be provided on a back end portion side of the nozzle.

Thereby, the jetting electrode is positioned near the upstream edge portion of the in-nozzle passage, so that the jetting electrode can be apart from the edge portion for jetting the liquid solution. Therefore, the effect of disturbance by the jetting electrode which continuously performs potential changes can be reduced and the liquid solution can be stably jetted.

Further, in each above described structure, preferably the nozzle is formed with an electrical insulating material, and an electrode for applying a jetting voltage is inserted in the nozzle or a plating to function as the electrode is formed.

Further, preferably the nozzle is formed with an electrical insulating material, an electrode for applying a jetting voltage is inserted in the nozzle or a plating to function as the electrode is formed, and an electrode for jetting is provided on the outside of the nozzle.

The electrode for jetting outside the nozzle is, for example, provided at the end surface of the edge portion side of the nozzle, or the entire circumference or a part of the side surface of the edge portion side of the nozzle.

Further, in addition to the operational effects by the above described structures, a jetting force can be improved. Thus, a droplet can be jetted with low voltage even when further making the nozzle diameter minute.

Further, preferably, the base material is formed with a conductive material or an insulating material.

Further, preferably, the jetting voltage to be applied is driven in the range described by the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\in_0$: electric constant [F/m], d: nozzle diameter [m], h: distance between nozzle and base material [m], k: proportionality constant dependent on nozzle shape (1.5<k<8.5)

Further, preferably, the jetting voltage to be applied is not more than 1000V.

By setting the upper limit of the jetting voltage in this way, jetting control can be made easy, and reliability can be easily improved by performing improvement of durability of the apparatus and security measures.

Further, preferably, the jetting voltage to be applied is not more than 500V.

By setting the upper limit of the jetting voltage in this way, jetting control can be further made easy, and reliability can be further improved easily by performing further improvement of durability of the apparatus and security measures.

Further, preferably, a distance between the nozzle and the base material is not more than 500 [μm], because high landing accuracy can be obtained even when making the nozzle diameter minute.

Further, preferably, the structure is such that a pressure is applied to the liquid solution in the nozzle.

Further, when jetting is performed at a single pulse, a pulse width Δt not less than a time constant τ determined by the following equation (2) may be applied.

$$\tau = \frac{\varepsilon}{\sigma} \tag{2}$$

where, ∈: dielectric constant of liquid solution [F/m], and σ: conductivity of liquid solution [S/m].

BRIEF DESCRIPTION OF THE DRAWINGS

FIG. 7 is a chart showing maximum electric field intensity under each condition of FIGS. 1 to FIGS. 6;

FIG. 17 is a chart showing results of a comparative study performed under a predetermined condition by changing a size of each part of the nozzle;

FIG. 18 is a chart showing results of a comparative study performed under a predetermined condition by changing a size of each part of the nozzle;

BEST MODE FOR CARRYING OUT THE INVENTION

A nozzle diameter of a liquid jetting apparatus described in the following each embodiment is preferably not more than 30 [μm], more preferably less than 20 [μm], even more preferably not more than 10 [μm], even more preferably not more than 8 [μm], and even more preferably not more than 4 [μm]. Also, the nozzle diameter is preferably more than 0.2 [μm]. Hereinafter, in regard to a relation between the nozzle diameter and an electric field intensity, descriptions will be hereafter made with reference to FIG. 1A to FIG. 6B. In correspondence with FIG. 1A to FIG. 6B, electric field intensity distributions in cases of the nozzle diameters being ø0.2, 0.4, 1, 8 and 20 [μm], and a case of a conventionally-used nozzle diameter being ø50 [μm] as a reference are shown.

Here, in FIG. 1A to FIG. 6B, a nozzle center position C indicates a center position of a liquid jetting surface of a liquid jetting hole at a nozzle edge. Further, FIG. 1A, FIG. 2A, FIG. 3A, FIG. 4A, FIG. 5A, and FIG. 6A indicate electric field intensity distributions when the distance between the nozzle and an counter electrode is set to 2000 [μm], and FIG. 1B, FIG. 2B, FIG. 3B, FIG. 4B, FIG. 5B, and FIG. 6B indicate electric field intensity distributions when the distance between the nozzle and the counter electrode is set to 100 [μm]. Here, an applying voltage is set constant to 200 [V] in each condition. A distribution line in FIG. 1A to FIG. 6B indicates a range of electric charge intensity from $1\times10^6$ [V/m] to $1\times10^7$ [V/m].

FIG. 7 shows a chart indicating the maximum electric field intensity under each condition.

Figure 1A:
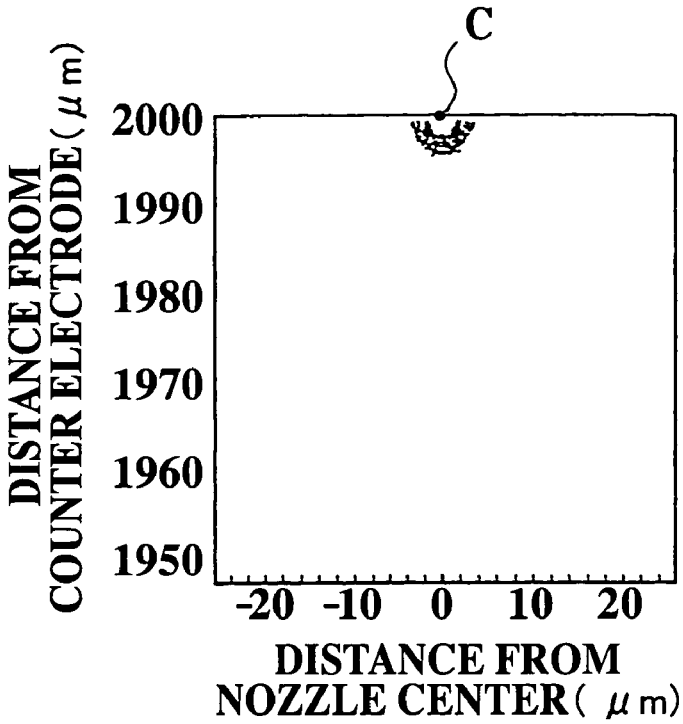
FIG. 1A is a view showing an electric field intensity distribution with a nozzle diameter as ø0.2 [μm] and with a distance from a nozzle to a counter electrode set to 2000 [μm]
Figure 1B:
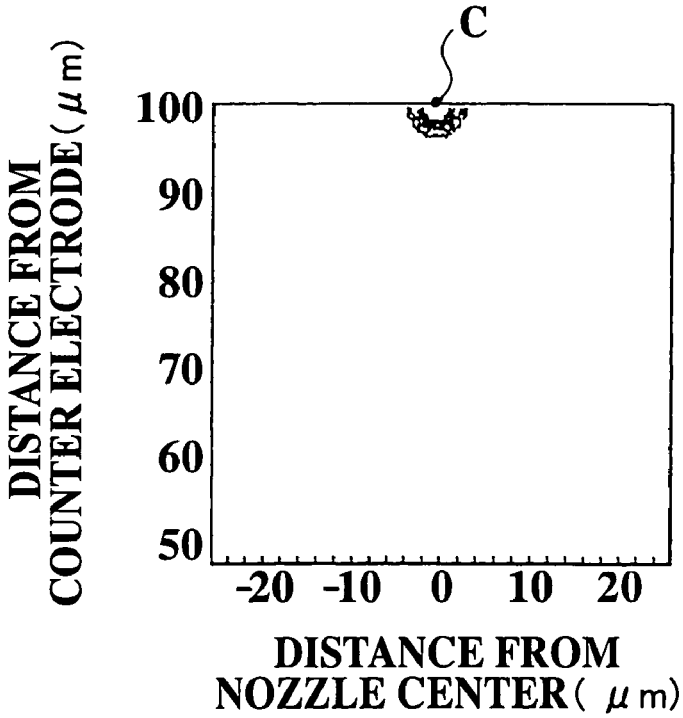
FIG. 1B is a view showing an electric field intensity distribution with the distance from the nozzle to the counter electrode set to 100 [μm]
Figure 2A:
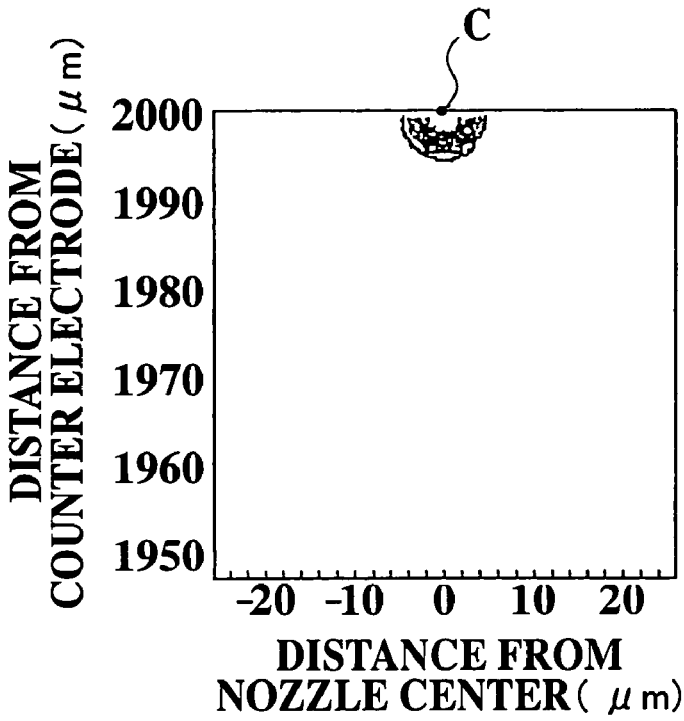
FIG. 2A is a view showing an electric field intensity distribution with the nozzle diameter as ø0.4 [μm] and with the distance from the nozzle to the counter electrode set to 2000 [μm]
Figure 2B:
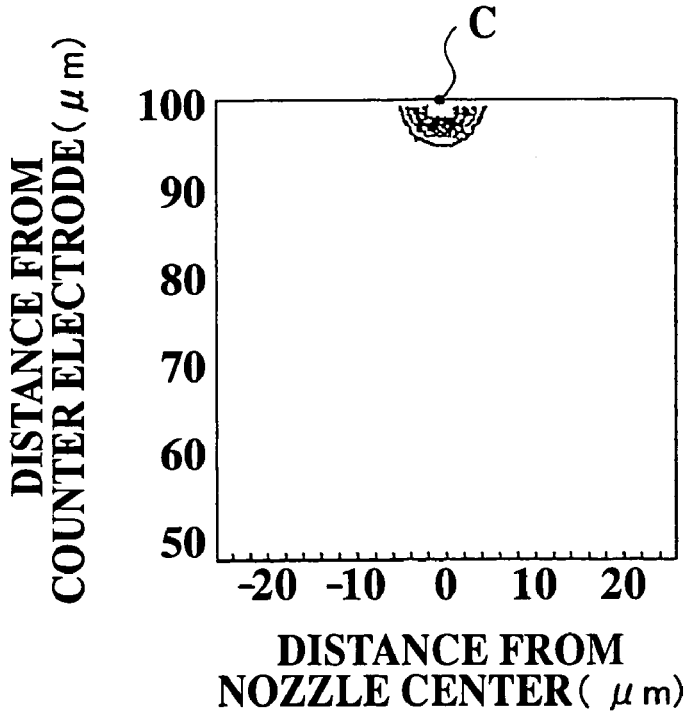
FIG. 2B is a view showing an electric field intensity distribution with the distance from the nozzle to the counter electrode set to 100 [μm]
Figure 3A:
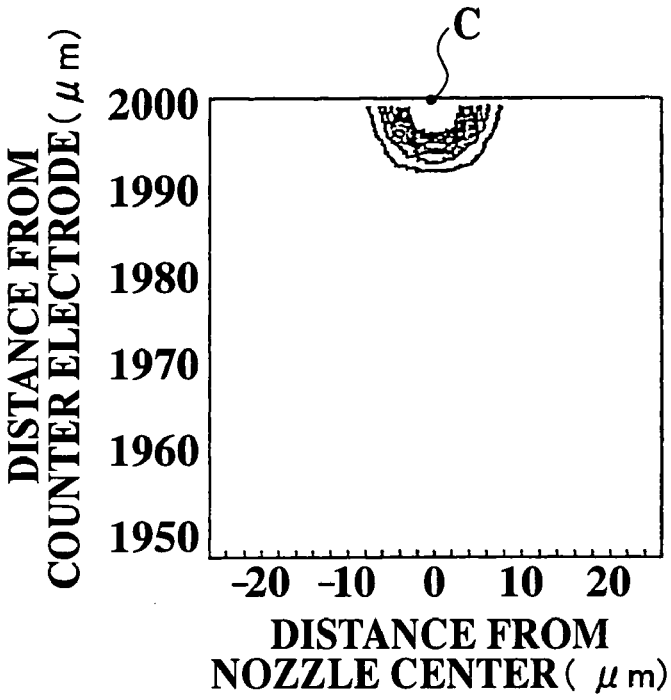
FIG. 3A is a view showing an electric field intensity distribution with the nozzle diameter as ø1 [μm] and with a distance from the nozzle to the counter electrode set to 2000 [μm]
Figure 3B:
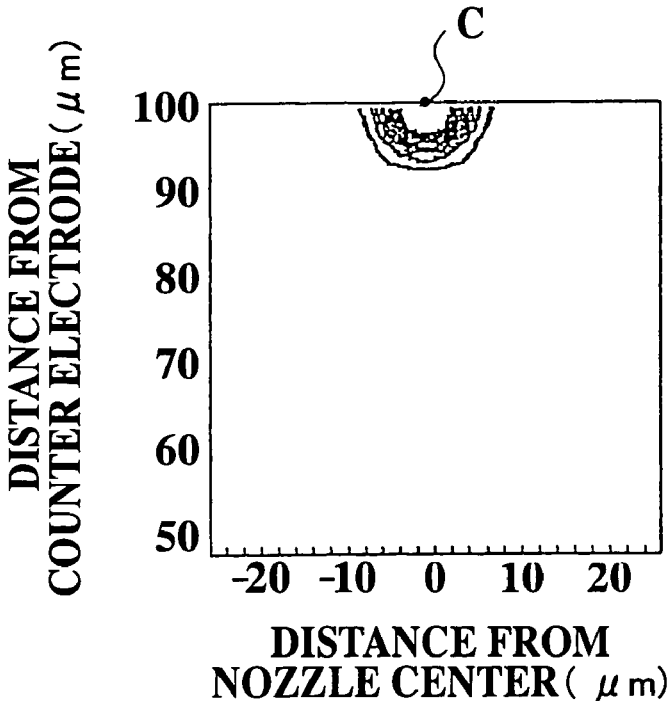
FIG. 3B is a view showing an electric field intensity distribution with the distance from the nozzle to the counter electrode set to 100 [μm]
Figure 4A:
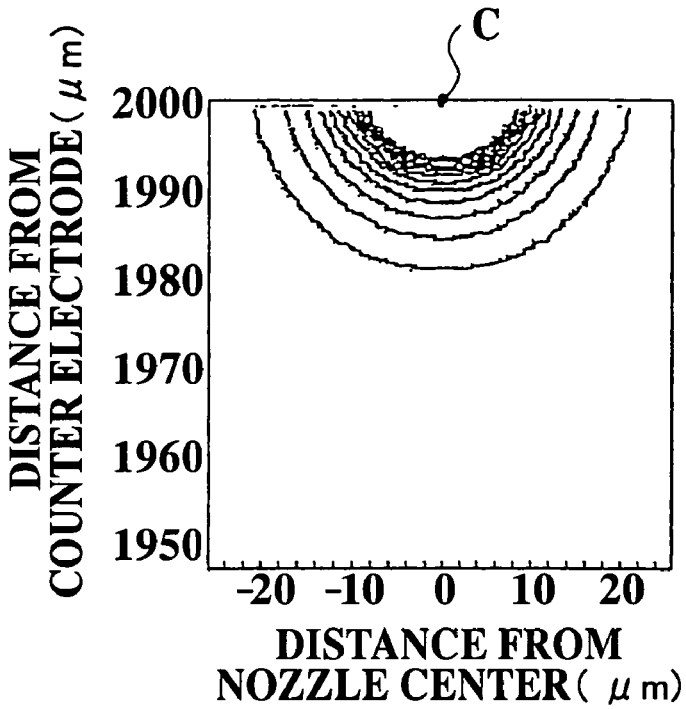
FIG. 4A is a view showing an electric field intensity distribution with the nozzle diameter as ø8 [μm] and with the distance from the nozzle to the counter electrode set to 2000 [μm]
Figure 4B:
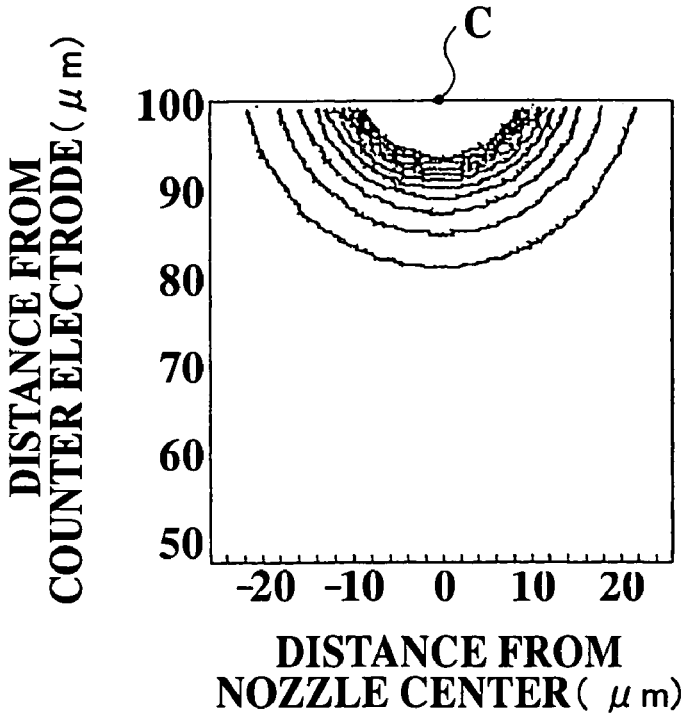
FIG. 4B is a view showing an electric field intensity distribution with the distance from the nozzle to the counter electrode set to 100 [μm]
Figure 5A:
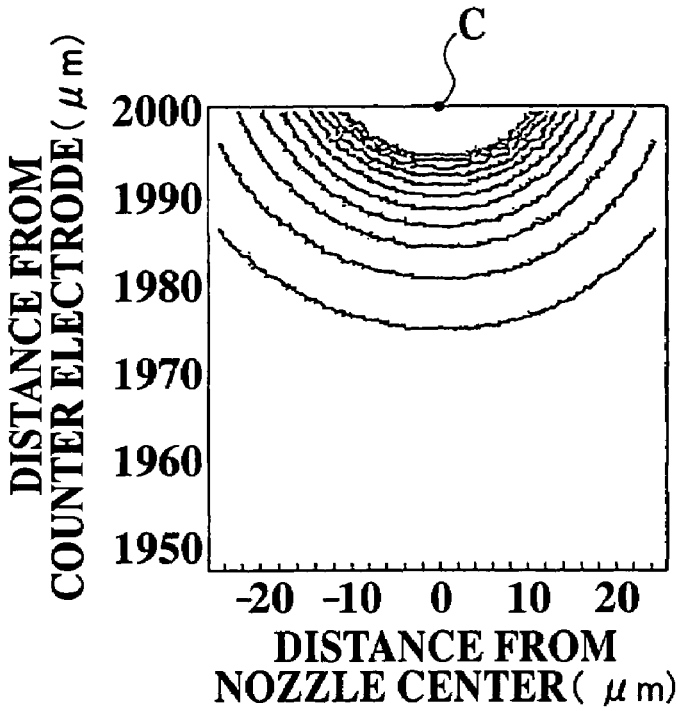
FIG. 5A is a view showing an electric field intensity distribution with the nozzle diameter as ø20 [μm] and with the distance from the nozzle to the counter electrode set to 2000 [μm]
Figure 5B:
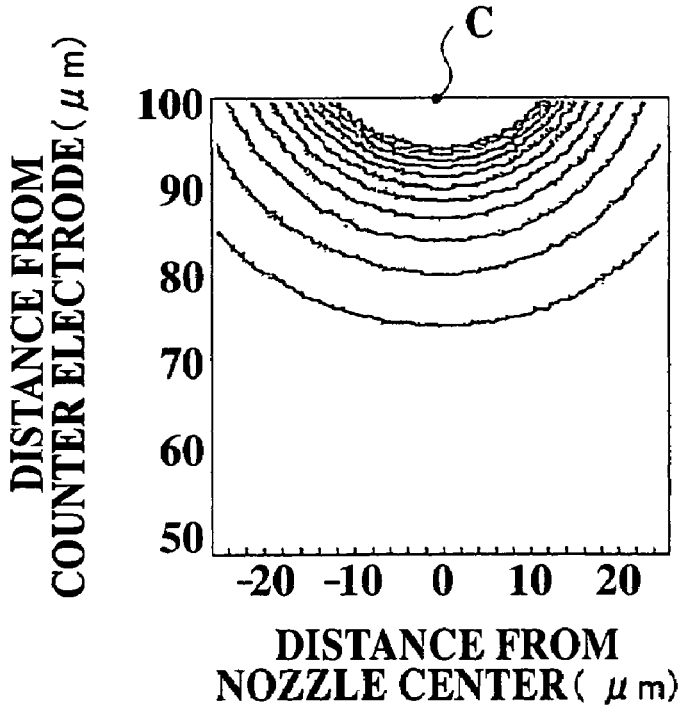
FIG. 5B is a view showing an electric field intensity distribution with the distance from the nozzle to the counter electrode set to 100 [μm]
Figure 6A:
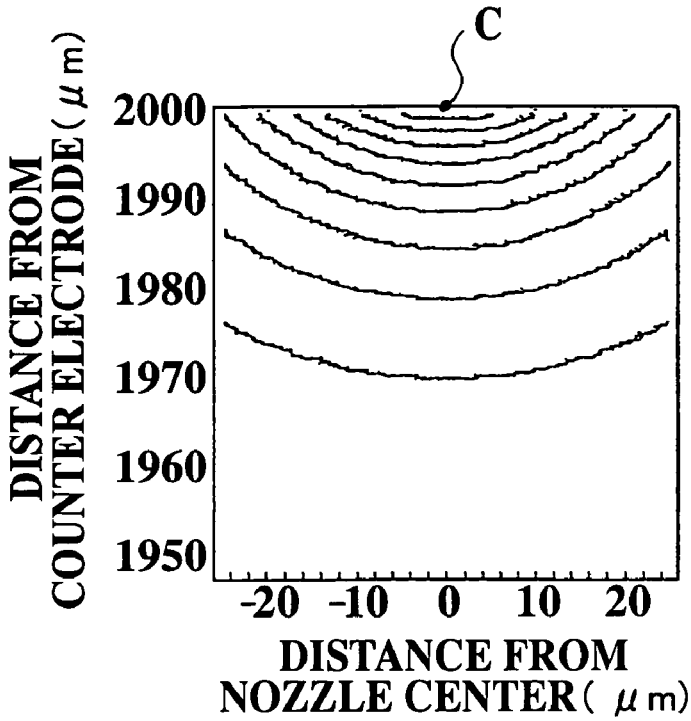
FIG. 6A is a view showing an electric field intensity distribution with the nozzle diameter as ø50 [μm] and with the distance from the nozzle to the counter electrode set to 2000 [μm]
Figure 6B:
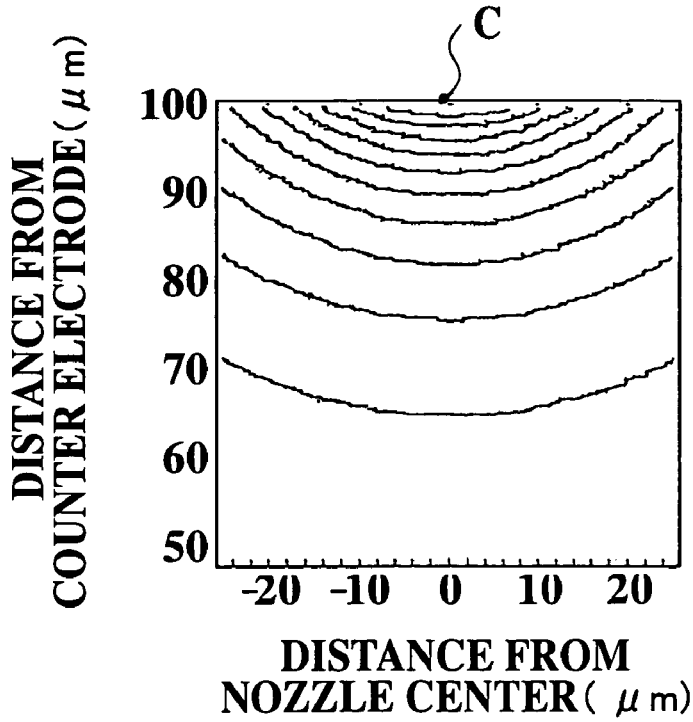
FIG. 6B is a view showing an electric field intensity distribution with the distance from the nozzle to the counter electrode set to 100 [μm]

According to FIG. 5A and FIG. 5B, the fact that the electric field intensity distribution spreads to a large area if the nozzle diameter is not less than ø20 [μm], was comprehended. Further, according to the chart of FIG. 7, the fact that the distance between the nozzle and the counter electrode has an influence on the electric field intensity was comprehended.

From these things, when the nozzle diameter is not more than ø8 [μm] (see FIG. 4A and FIG. 4B), the electric field intensity is concentrated and change of a distance to the counter electrode scarcely has an influence on the electric field intensity distribution. Therefore, when the nozzle diameter is not more than ø8 [μm], it is possible to perform a stable jetting without suffering influence of position accuracy of the counter electrode, and unevenness of base material property and thickness. Next, a relation between the nozzle diameter of the nozzle and the maximum electric field intensity and an intense electric field area when a liquid level is at the edge position of the nozzle is shown in FIG. 8.

Figure 8:
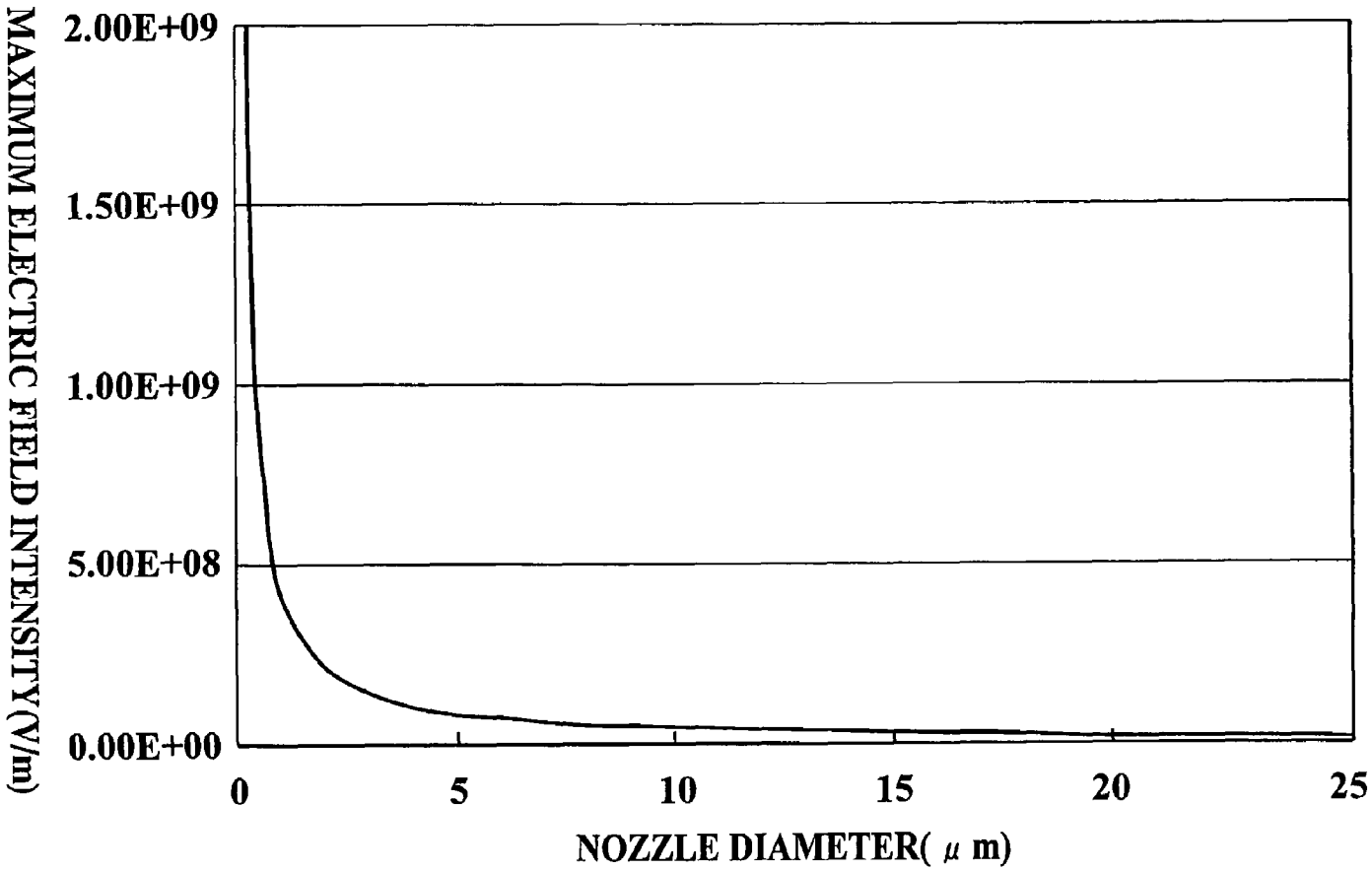
FIG. 8 is a diagram showing a relation between the nozzle diameter of the nozzle, and maximum electric field intensity and an intense electric field area at a meniscus.

According to the graph shown in FIG. 8, when the nozzle diameter is not more than ø4 [μm], the fact that the electric field concentration grows extremely large and the maximum electric field intensity is made high was comprehended. Thereby, since it is possible to make an initial jetting speed of the liquid solution large, flying stability of a droplet is increased and a moving speed of an electric charge at the nozzle edge portion is increased, thereby jetting responsiveness improves.

Continuously, in regard to maximum electric charge amount chargeable to a jetted droplet, description will be made hereafter. Electric charge amount chargeable to a droplet is shown as the following equation (3), in consideration of Rayleigh fission (Rayleigh limit) of a droplet.

$$q = 8\times\pi\times\sqrt{\varepsilon_0\times\gamma\times\frac{d_0^3}{8}} \tag{3}$$

where q is electric charge amount [C] giving Rayleigh limit, $\in_0$ is electric constant [F/m], γ is surface tension of the liquid solution [N/m], and $d_0$ is diameter [m] of the droplet.

The closer to a Rayleigh limit value the electric charge amount q calculated by the above-mentioned equation (3) is, the stronger an electrostatic force becomes even with the same electric field intensity, thereby improving jetting stability. However, when it is too close to the Rayleigh limit value, conversely a dispersion of the liquid solution occurs at a liquid jet opening of the nozzle, and there is lack of jetting stability.

Figure 9:
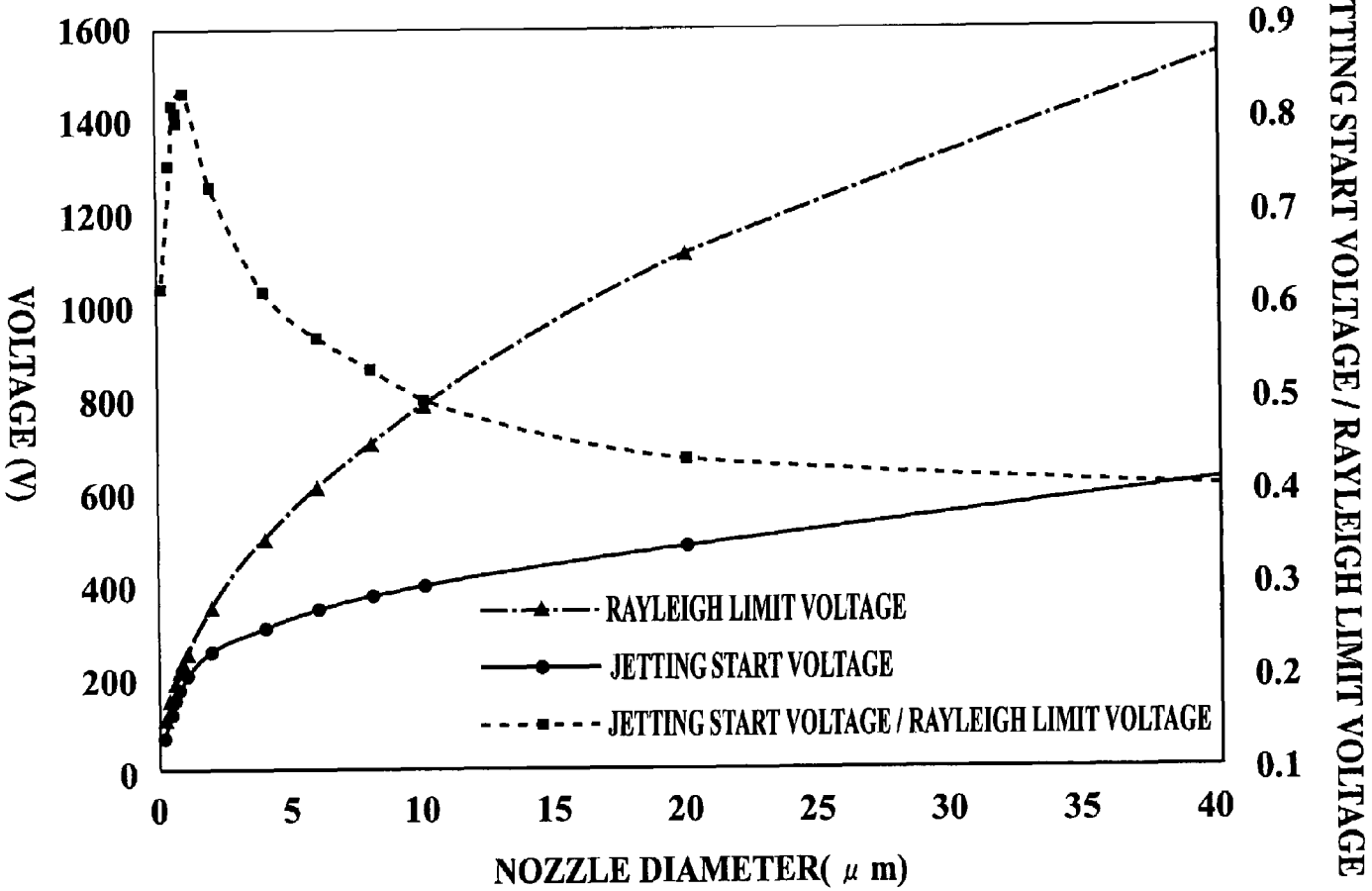
FIG. 9 is a diagram showing a relation among the nozzle diameter of the nozzle, a jetting start voltage at which a droplet jetted at the meniscus starts flying, a voltage value at Rayleigh limit of the initial jetted droplet, and a ratio of the jetting start voltage to the Rayleigh limit voltage.

Here, FIG. 9 is a graph showing a relation among the nozzle diameter of the nozzle, a jetting start voltage at which a droplet jetted at the nozzle edge portion starts flying, a voltage value at Rayleigh limit of the initial jetted droplet, and a ratio of the jetting start voltage to the Rayleigh limit voltage.

From the graph shown in FIG. 9, within the range of the nozzle diameter from ø0.2 [μm] to ø4 [μm], the ratio of the jetting start voltage and the Rayleigh limit voltage value exceeds 0.6, and a favorable result of electric charge efficiency of a droplet is obtained. Thereby, it is comprehended that it is possible to perform a stable jetting within the range.

Figure 10:
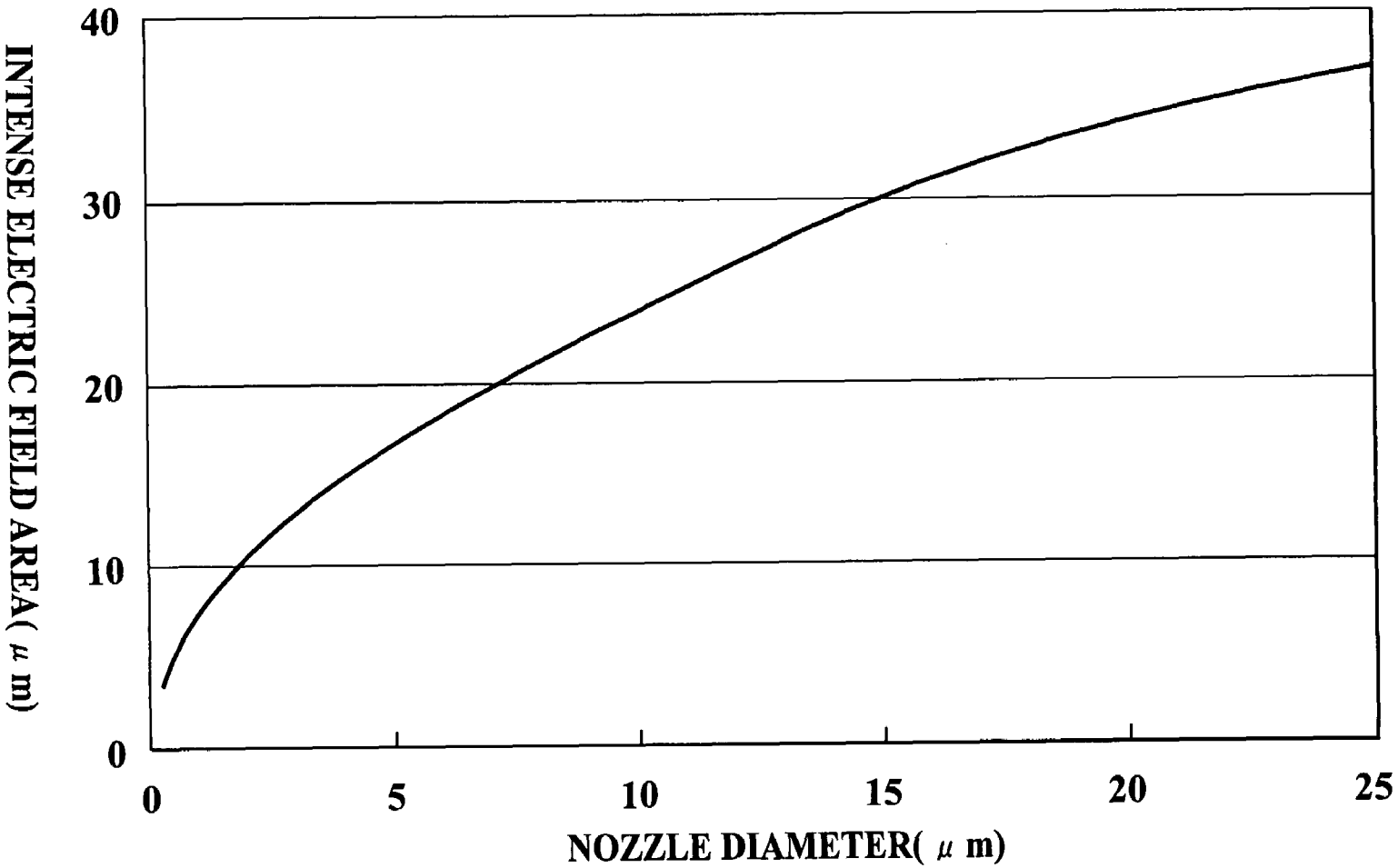
FIG. 10 is a graph described by a relation between the nozzle diameter and the intense electric field area at the meniscus.

For example, in a graph represented by a relation between a nozzle diameter and an intense electric field (not less than $1\times10^6$ [V/m]) area at the nozzle edge portion shown in FIG. 10, the fact that an area of the electric field concentration becomes extremely narrow when the nozzle diameter is not more than ø0.2 [μm] is indicated. Thereby, the fact that a jetted droplet is not able to sufficiently receive energy for acceleration and flying stability is reduced is indicated. Therefore, preferably the nozzle diameter is set to more than ø0.2 [μm].

First Embodiment (Whole Structure of Liquid Jetting Apparatus)

Figure 11:
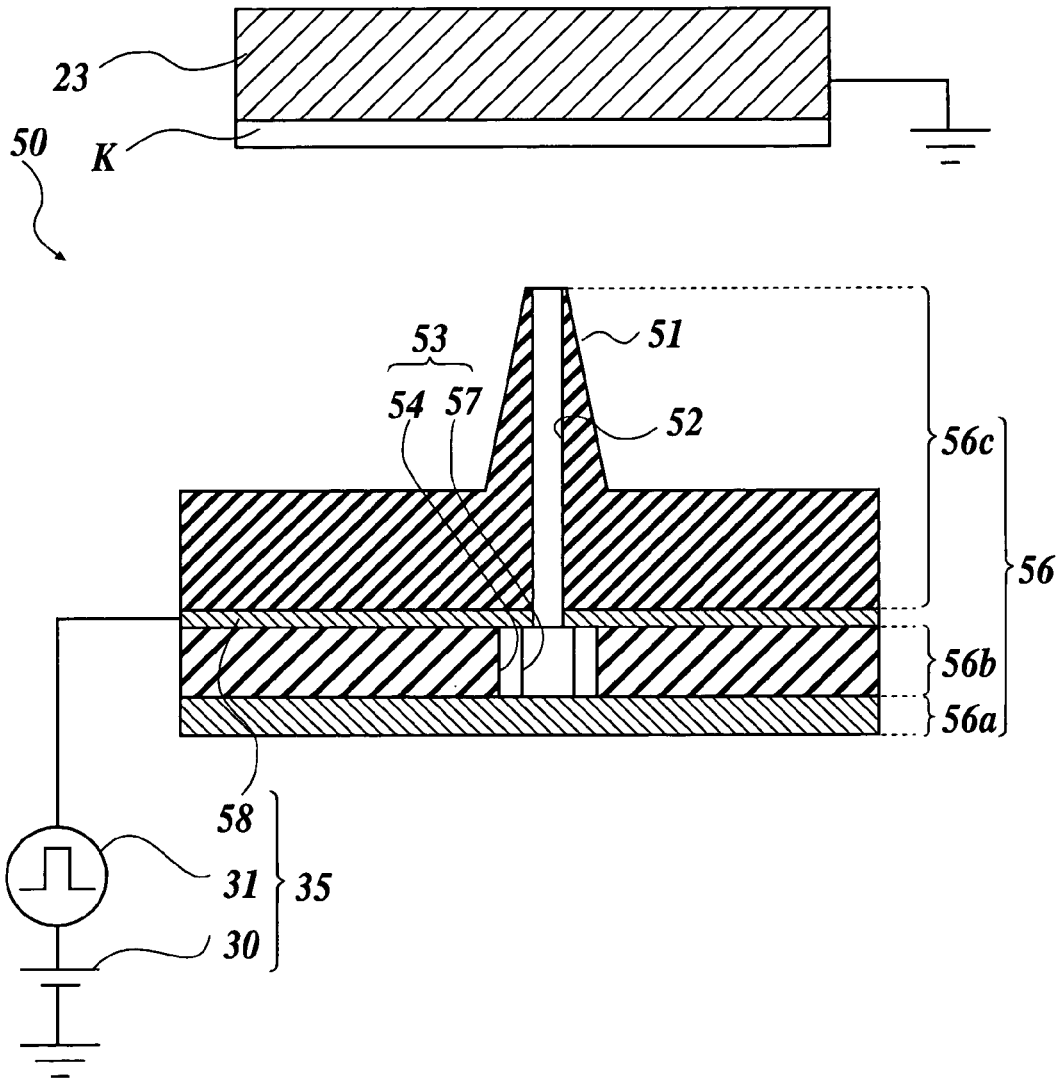
FIG. 11 is a sectional view along the nozzle of the liquid jetting apparatus in the first embodiment.

A liquid jetting apparatus will be described below with reference to FIG. 11 to FIGS. 14. FIG. 11 is a sectional view of the liquid jetting apparatus 50 along a nozzle 51 to be described later.

The liquid jetting apparatus 50 is provided on a nozzle plate 56*d* and comprises the nozzle 51 having a super minute diameter for jetting a droplet of chargeable liquid solution from its edge portion, a counter electrode 23 which has a facing surface to face the edge portion of the nozzle 51 and supports a base material K receiving a droplet at the facing surface, a liquid solution supplying section 53 for supplying the liquid solution to a passage 52 in the nozzle 51, a jetting voltage applying section 35 for applying a jetting voltage to the liquid solution in the nozzle 51, and a liquid solution sucking section 40 for sucking the liquid solution in the nozzle 51. The above-mentioned nozzle 51, a partial structure of the liquid solution supplying section 53 and a partial structure of the jetting voltage applying section 35 are integrally formed as a liquid jetting head.

In FIG. 11, for the convenience of a description, a state where the edge portion of the nozzle 51 faces upward and the counter electrode 23 is provided above the nozzle 51 is illustrated. However, practically, the apparatus is so used that the nozzle 51 faces in a horizontal direction or a lower direction than the horizontal direction, more preferably, the nozzle 51 faces perpendicularly downward.

(Liquid Solution)

As an example of the liquid solution jetted by the above-mentioned liquid jetting apparatus 50, as inorganic liquid, water, $COCl_2$, HBr, $HNO_3$, $H_3PO_4$, $H_2SO_4$, $SOCl_2$, $SO_2CL_2$, $FSO_2H$ and the like can be cited. As organic liquid, alcohols such as methanol, n-propanol, isopropanol, n-butanol, 2-methyl-1-propanol, tert-butanol, 4-metyl-2-pentanol, benzyl alcohol, α-terpineol, ethylene glycol, glycerin, diethylene glycol, triethylene glycol and the like; phenols such as phenol, o-cresol, m-cresol, p-cresol and the like; ethers such as dioxiane, furfural, ethyleneglycoldimethylether, methylcellosolve, ethylcellosolve, butylcellosolve, ethylcarbitol, buthylcarbito, buthylcarbitolacetate, epichlorohydrin and the like; ketones such as acetone, ethyl methyl ketone, 2-methyl-4-pentanone, acetophenone and the like; aliphatic acids such as formic acid, acetic acid, dichloroacetate, trichloroacetate and the like; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzonate, diethyl malonate, dimethyl phthalate, diethyl phthalate, diethyl carbonate, ethylene carbonate, propylene carbonate, cellosolve acetate, butylcarbitol acetate, ethyl acetoacetate, methyl cyanoacetate, ethyl cyanoacetate and the like; nitrogen-containing compounds such as nitromethane, nitrobenzene, acetonitrile, propionitrile, succinonitrile, valeronitrile, benzonitrile, ethyl amine, diethyl amine, ethylenediamine, aniline, N-methylaniline, N,N-dimethylaniline, o-toluidine, p-toluidine, piperidine, pyridine, α-picoline, 2,6-lutidine, quinoline, propylene diamine, formamide, N-methylformamide, N,N-dimethylformamide, N,N-diethylformamide, acetamide, N-methylacetamide, N-methylpropionamide, N,N,N',N'-tetramethylurea, N-methylpyrrolidone and the like; sulfur-containing compounds such as dimethyl sulfoxide, sulfolane and the like; hydro carbons such as benzene, p-cymene, naphthalene, cyclohexylbenzene, cyclohexyene and the like; halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutan, 1-chloro-2-methylpropane, 2-chloro-2-methylpropane, bromomethane, tribromomethane, 1-promopropane and the like can be cited. Further, two or more types of each of the mentioned liquids may be mixed to be used as the liquid solution.

Further, conductive paste which includes large portion of material having high electric conductivity (silver pigment or the like) is used, and in the case of performing the jetting, as objective material for being dissolved into or dispersed into the above-mentioned liquid, excluding coarse particles causing clogging to the nozzles, it is not in particular limited. As fluorescent material such as PDP, CRT, FED or the like, what is conventionally known can be used without any specific limitation. For example, as red fluorescent material, (Y,Gd)$BO_3$:Eu, $YO_3$:Eu and the like, as red fluorescent material, $Zn_2SiO_4$:Mn, $BaAl_{12}O_{19}$:Mn, (Ba,Sr,Mg)O.α-$Al_2O_3$:Mn and the like, blue fluorescent material, $BaMgAl_{14}O_{23}$:Eu, $BaMgAl_{10}O_{17}$:Eu and the like can be cited. In order to make the above-mentioned objective material adhere on a recording medium firmly, it is preferably to add various types of binders. As a binder to be used, for example, cellulose and its derivative such as ethyl cellulose, methyl cellulose, nitrocellulose, cellulose acetate, hydroxyethyl cellulose and the like; alkyd resin; (metha)acrylate resin and its metal salt such as polymethacrytacrylate, polymethylmethacrylate, 2-ethylhexylmethacrylate•methacrylic acid copolymer, lauryl methacrylate•2-hydroxyethylmethacrylate copolymer and the like; poly(metha)acrylamide resin such as poly-N-isopropylacrylamide, poly-N,N-dimethylacrylamide and the like; styrene resins such as polystyrene, acrylonitrile•styrene copolymer, styrene•maleate copolymer, styrene•isoprene copolymer and the like; various saturated or unsaturated polyester resins; polyolefin resins such as polypropylene and the like; halogenated polymers such as polyvinyl chloride, polyvinylidene chloride and the like; vinyl resins such as poly vinyl acetate, chloroethene•polyvinyl acetate copolymer and the like; polycarbonate resin; epoxy resins; polyurethane resins; polyacetal resins such as polyvinyl formal, polyvinyl butyral, polyvinyl acetal and the like; polyethylene resins such as ethylene•vinyl acetate copolymer, ethylene•ethyl acrylate copolymer resin and the like; amide resins such as benzoguanamine and the like; urea resin; melamine resin; polyvinyl alcohol resin and its anion cation degeneration; polyvinyl pyrrolidone and its copolymer; alkylene oxide homopolymer, copolymer and cross-linkage such as polyethelene oxide, polyethelene oxide carboxylate and the like; polyalkylene glycol such as polyethylene glycol, polypropylene glycol and the like; poryether polyol; SBR, NBR latex; dextrin; sodium alginate; natural or semi-synthetic resins such as gelatin and its derivative, casein, Hibiscus manihot, gum traganth, pullulan, gum arabic, locust bean gum, guar gum, pectin, carrageenan, glue, albumin, various types of starches, corn starch, arum root, funori, agar, soybean protein and the like; terpene resin; ketone resin; rosin and rosin ester; polyvinylmethylether, polyethyleneimine, polystyrene sulfonate, polyvinyl sulfonate and the like can be used. These resins may not only be used as homopolymer but be blended within a mutually soluble range to be used.

(Nozzle)

The above nozzle 51 is integrally formed with a nozzle plate 56*c* to be described later, and is provided to stand up perpendicularly with respect to a flat plate surface of the nozzle plate 56*c*. Further, at the time of jetting a droplet, the nozzle 51 is used to perpendicularly face a receiving surface (surface where the droplet lands) of the base material K. Further, in the nozzle 51, the in-nozzle passage 52 penetrating from its edge portion along the nozzle center is formed.

Figure 12A:
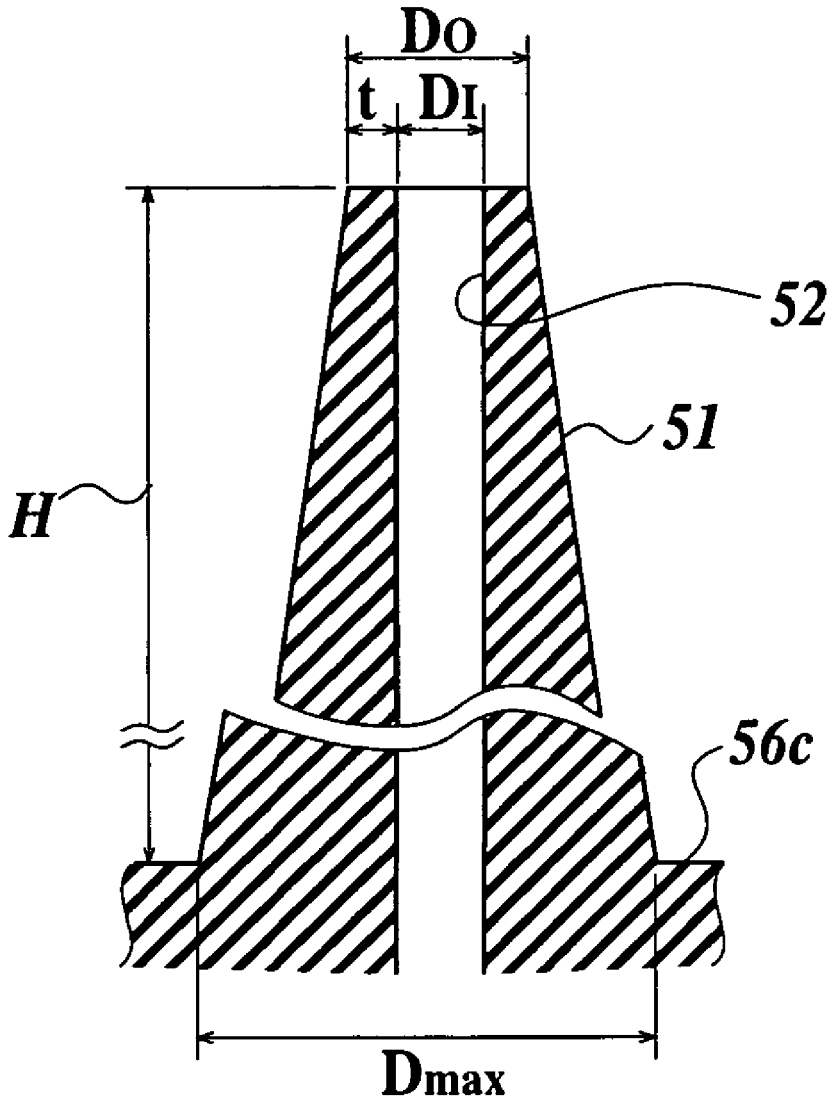
FIG. 12 is an explanation view describing references showing each size at the edge portion of the nozzle.
Figure 13A:
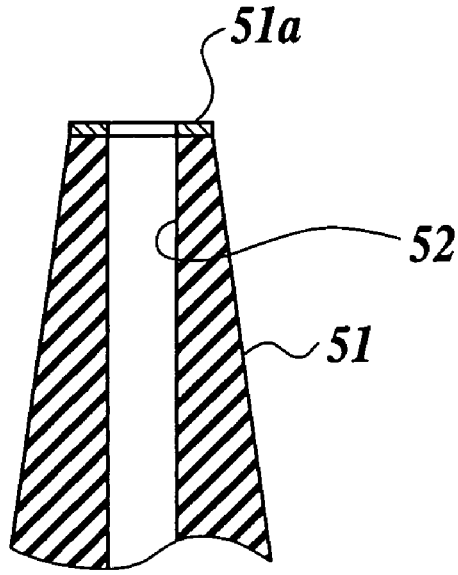
FIG. 13A is an explanation view showing a water repellent processed state at the edge portion of the nozzle.
Figure 13B:
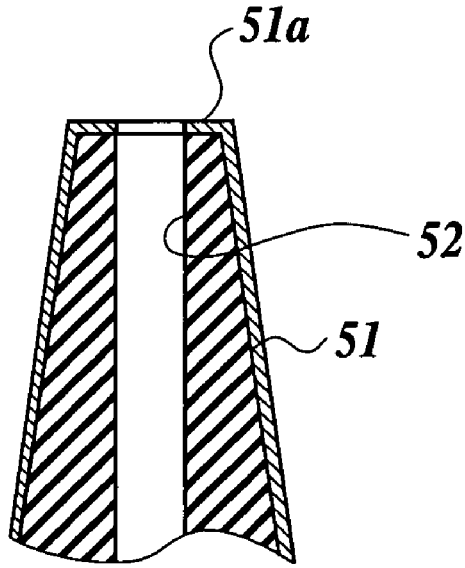
FIG. 13B is an explanation view showing other example of the water repellent processing.

The nozzle 51 will be described in more detail referring to FIG. 12 to FIGS. 13. FIG. 12 is an explanation view describing references showing each size at the edge portion of the nozzle 51, FIG. 13A is an explanation view showing a water repellent processed state at the edge portion of the nozzle 51, and FIG. 13B is an explanation view showing other example of the water repellent processing.

In the nozzle 51, an opening diameter of its edge portion and the in-nozzle passage 52 are uniform. As mentioned, these are formed as a super minute diameter, and are preferably not more than 30 [μm], more preferably less than 20 [μm], even more preferably not more than 10 [μm], even more preferably not more than 8 [μm], and even more preferably not more than 4 [μm]. As one concrete example of dimensions of each part, an inside diameter $D_I$ of the in-nozzle passage 52 along the entire length from the edge portion of the nozzle is set to 1 [μm] to perform concentration of the electric field due to the super miniaturized nozzle. An outside diameter $D_0$ of the nozzle at the nozzle edge portion is set to 2 [μm], a wall thickness t of the tube at the edge portion of the nozzle 51 is set to 0.5 [μm] which is smaller than the length equal to the inside diameter $D_I$ to miniaturize the edge surface of the nozzle 51, thereby miniaturizing the outer diameter of the convex meniscus of the liquid solution formed at the edge portion. For further miniaturizing the edge surface of the nozzle 51, the value t may be set to not more than ¼ of the inside diameter $D_I$ (for example, 0.2 [μm]).

A diameter $D_{max}$ of the root of the nozzle 51 is 5 [μm], and a circumferential surface of the nozzle is formed to be a taper.

The nozzle diameter is preferably more than 0.2 [μm]. The height of the nozzle 21 may be 0 [μm].

Further, the height of the nozzle 51 (protruding height from the plane of the jetting side of an upper surface layer 56*c* to be described later) is set to 100 [μm], and is formed as a conic trapezoid shape being boundlessly close to a conic shape. Since the in-nozzle passage 52 is provided to penetrate through the nozzle 51 and the flat portion of the nozzle plate 56*c* positioned thereunder, the passage length of the in-nozzle passage 52 becomes not less than 100 [μm] by setting the height of the nozzle 51 to the above value. In this way, by setting the passage length of the in-nozzle passage 52 to not less than ten times, preferably 50 times, and more preferably 100 times of the inside diameter of the nozzle at the nozzle edge portion, a jetting force received from the concentrated electric field can be concentrated more effectively at the edge portion of the nozzle 51.

The entire nozzle 51 as well as the nozzle plate 56*c* is made of glass as insulating material, and is formed by femtosecond laser to be the shape and the size in the drawing.

As shown in FIG. 13A, a water repellent coating 51*a* is formed on the edge surface excluding the passage 52 of the nozzle 51. The water repellent coating 51*a* is formed by, for example, amorphous carbon deposition. Also, the water repellent coating 51*a* may be, as shown in FIG. 13B, formed not only on the edge portion of the nozzle 51 but on the entire surface of the nozzle 51.

Figure 16A:
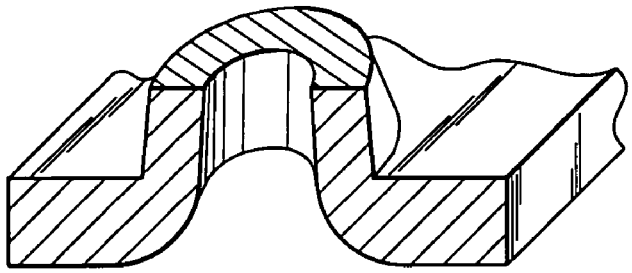
FIG. 16A is a partially broken perspective view showing an example of a shape of an in-nozzle passage providing roundness at a liquid solution room side.
Figure 16B:
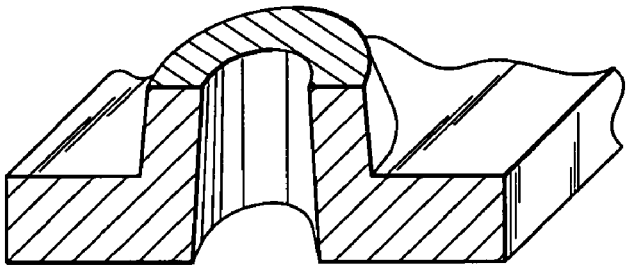
FIG. 16B is a partially broken perspective view showing an example of a shape of the in-nozzle passage having an inside surface thereof as a tapered circumferential surface.
Figure 16C:
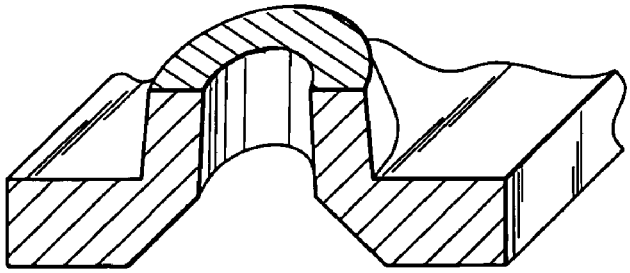
FIG. 16C is a partially broken perspective view showing an example of a shape of the in-nozzle passage combining the tapered circumferential surface and a linear passage.

A shape of the in-nozzle passage 52 may not be formed linearly with the inside diameter constant as shown in FIG. 11. For example, as shown in FIG. 16A, it may be so formed as to give roundness to a cross-section shape at the edge portion of the side of a liquid solution room 54 to be described later, of the in-nozzle passage 52. Further, as shown in FIG. 16B, an inside diameter at the end portion of the side of the liquid solution room 54 to be described later, of the in-nozzle passage 52 may be set to be larger than an inside diameter of the end portion of the jetting side, and an inside surface at the in-nozzle passage 52 may be formed in a tapered circumferential surface shape. Further, as shown in FIG. 16C, only the end portion at the side of the liquid solution room 54 to be describe later, of the in-nozzle passage 52 may be formed in a tapered circumferential surface shape and the jetting end portion side with respect to the tapered circumferential surface may be formed linearly with the inside diameter constant.

(Liquid Solution Supplying Section)

The liquid solution supplying section 53 is provided at a position being inside of the liquid jetting head 26 and at the root of the nozzle 51, and comprises the liquid solution room 54 communicated to the in-nozzle passage 52, and a supplying passage 57 for guiding the liquid solution from an external liquid solution tank which is not shown, to the liquid solution room 54.

The above-mentioned liquid solution tank is arranged at the position higher than the nozzle plate 56 for supplying the liquid solution to the liquid solution room 54 with moderate pressure by its own weight.

As described above, supplying the liquid solution may be performed by utilizing a pressure difference according to arrangement positions of the liquid jetting head 56 and the supplying tank, however, a supplying pump may be used for supplying the liquid solution. In this case, the supplying pump supplies the liquid solution to the edge portion of the nozzle 51, and performs supplying the liquid solution while maintaining the supplying pressure in the range where leakage from the edge portion does not occur. Although it depends upon the design of the pump system, basically, the supplying pump operates when supplying the liquid solution to the liquid jetting head 56 at the start time, jetting the liquid from the liquid jetting head 56, and supplying of the liquid solution according thereto is performed while optimizing capacity change in the liquid jetting head 56 by a capillary and the convex meniscus forming section and each pressure of the supplying pumps.

(Jetting Voltage Applying Section)

The jetting voltage applying section 35 comprises a jetting electrode 58 for applying the jetting voltage at the back end side of the nozzle 51 in the nozzle plate 56, that is at a border position between the liquid solution room 54 and the in-nozzle passage 52, a bias current power source 30 for always applying a direct current bias voltage to this jetting electrode 58 and a jetting voltage power source 31 for applying the jetting pulse voltage to the jetting electrode 58 with the bias voltage superimposed to be an electric potential for jetting.

The above-mentioned jetting electrode 58 is directly contacted to the liquid solution in the liquid solution room 54, for charging the liquid solution and applying the jetting voltage.

The jetting electrode 58 is arranged on the back end portion (end portion opposite to the edge portion) side of the nozzle 51 of the nozzle plate surface to be apart from the edge portion as much as possible, so that the effect by rapid voltage change of the jetting pulse voltage to be applied or the like to the nozzle edge portion can be reduced.

In regard to a bias voltage by the bias power source 30, by applying a voltage always within a range within which jetting of the liquid solution is not performed, width of a voltage applied at the time of jetting is preliminarily reduced, and thereby responsiveness at the time of jetting is improved.

The jetting voltage power source 31 outputs a pulse voltage only when jetting of the liquid solution is performed, and applies to the jetting electrode 58 by superimposing to the bias voltage which is output to be always constant. A value of the pulse voltage is set so that the superimposed voltage V at this time satisfies a condition of the following equation (1).

$$h\sqrt{\frac{\gamma\pi}{\varepsilon_0 d}} > V > \sqrt{\frac{\gamma k d}{2\varepsilon_0}} \tag{1}$$

where, γ: surface tension of liquid solution [N/m], $\in_0$: electric constant [F/m], d: nozzle diameter [m], h: distance between nozzle and base material [m], k: proportionality constant dependent on nozzle shape (1.5<k<8.5).

As one example, the bias voltage is applied at DC300 [V], and the pulse voltage is applied at 100 [V]. Therefore, the superimposed voltage at jetting is 400 [V].

(Liquid Jetting Head)

The liquid jetting head 56 comprises a base layer 56*a* placed at the lowest layer in FIG. 11, a passage layer 56*b* which is placed on top thereof and forms a supplying passage of the liquid solution, and the nozzle plate 56*c* formed further on top of this passage layer 56*b*. The above-mentioned jetting electrode 58 is inserted between the passage layer 56*b* and the nozzle plate 56*c*.

The above-mentioned base layer 56*a* is formed from silicon base plate, highly-insulating resin or ceramic, and a photoresist layer is formed on top thereof and it is eliminated except for a part corresponding to the supplying path 57 and the liquid solution room 54 by the insulating resin layer by developing, exposing and dissolving a pattern of the supplying path 57 and the liquid solution room 54, and the insulating resin layer is formed at the eliminated part. This insulating resin layer functions as the passage layer 56*b*. Then, the jetting electrode 58 is formed on an upper surface of this insulating resin layer with plating of a conductive element (for example NiP), and further on top thereof, the nozzle plate 56*c* made of glass material processed by femtosecond laser as described above is formed.

Then, the soluble resin layer corresponding to the pattern of the supplying passage 57 and the liquid solution room 54 is eliminated, and these supplying passage 57 and the liquid solution room 54 are communicated. Finally, deposition of amorphous carbon is performed at the edge portion of the nozzle 51 to form the water repellent coating 51*a*, thereby the production of the nozzle plate 56*c* is completed.

Material of the nozzle plate 56*c* and the nozzle 51 may be, concretely, semiconductor such as Si or the like, conductive material such as Ni, SUS or the like, other than insulating material such as epoxy, PMMA, phenol, soda glass. However, in a case of forming the nozzle plate 56*c* and the nozzle 51 from conductive material, at least at the edge portion edge surface of the edge portion of the nozzle 51, more preferably at the circumferential surface of the edge portion, coating by insulating material is preferably provided. This is because, by forming the nozzle 51 from insulating material or forming the insulating material coating at its edge portion surface, at the time of applying the jetting voltage to the liquid solution, it is possible to effectively suppress leakage of electric current from the nozzle edge portion to the counter electrode 53.

(Counter Electrode)

The counter electrode 23 comprises a facing surface perpendicular to a protruding direction of the nozzle 51, and supports the base material K along the facing surface. A distance from the edge portion of the nozzle 51 to the facing surface of the counter electrode 23 is, as one example, set to 100 [μm].

Further, since this counter electrode 23 is grounded, the counter electrode 23 always maintains grounded potential. Therefore, a droplet jetted by an electrostatic force by electric field generated between the edge portion of the nozzle 51 and the facing surface is guided to a side of the counter electrode 23 at the time of applying the pulse voltage.

Since the liquid jetting apparatus 50 jets a droplet by enhancing the electric field intensity by the electric field concentration at the edge portion of the nozzle 51 according to super-miniaturization of the nozzle 51, it is possible to jet the droplet without the guiding by the counter electrode 23. However, the guiding by an electrostatic force between the nozzle 51 and the counter electrode 23 is preferably performed. Further, it is possible to let out the electric charge of a charged droplet by grounding the counter electrode 23.

(Jetting Operation of Minute Droplet by Liquid Jetting)

Figure 14A:
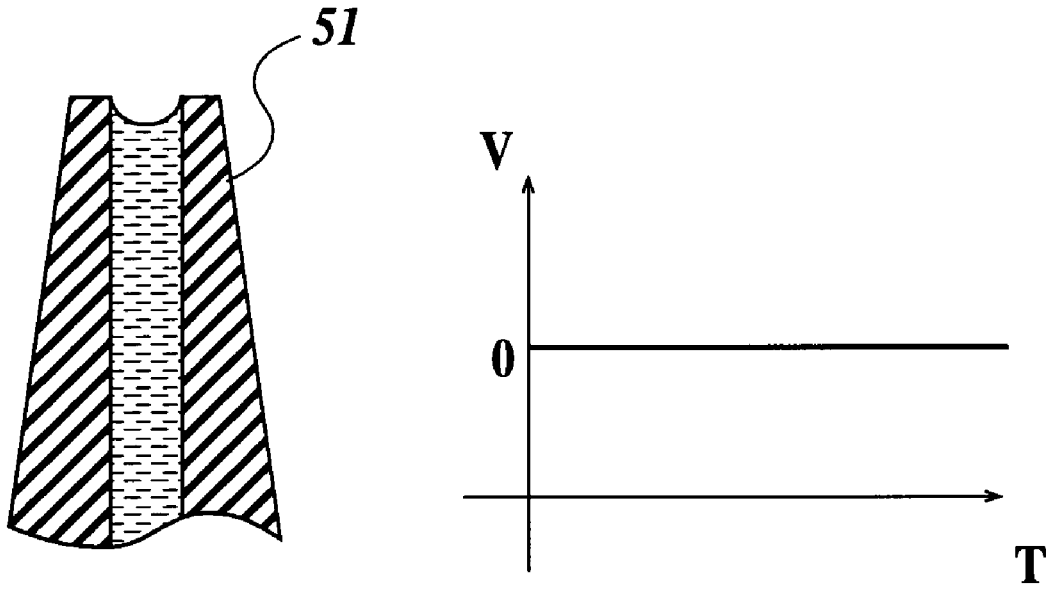
FIG. 14A is an explanation view of a relation between a jetting operation of liquid solution and a voltage applied to the liquid solution in a state where the jetting is not performed.
Figure 14B:
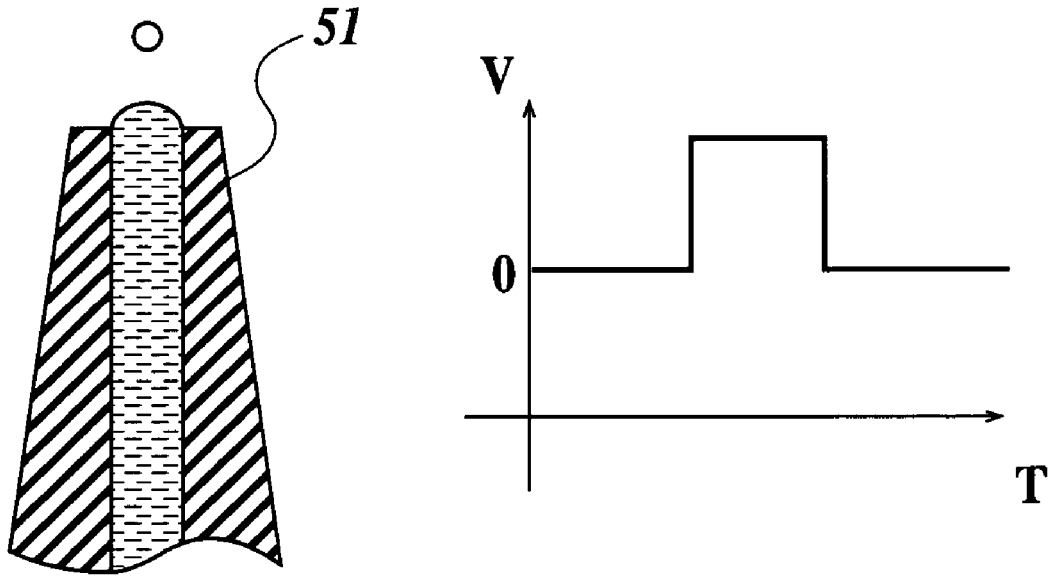
FIG. 14B is an explanation view showing the jetting state.

An operation of the liquid jetting apparatus 50 will be described with reference to FIG. 14A to FIG. 14B. FIG. 14A and FIG. 14B are explanation views of a relation with a voltage applied to the liquid solution, wherein FIG. 14A shows a state where the jetting is not performed, and FIG. 14B shows the jetting state.

The state is such that the liquid solution has already been supplied to the in-nozzle passage 52, and in this state, the bias voltage is applied to the liquid solution via the jetting electrode 58 by the bias power source 30. In this state, the liquid solution is charged, and meniscus which dents in a reentrant form at the liquid solution is formed at the edge portion of the nozzle 51 (FIG. 14A).

When the jetting pulse voltage is applied by the jetting voltage power source 31, the liquid solution is guided to the edge portion side of the nozzle 51 by an electrostatic force by electric field intensity of the concentrated electric field at the edge portion of the nozzle 51, the convex meniscus protruding outward is formed, and the electric field is concentrated at a top of the convex meniscus, and after all, a minute droplet is jetted to the counter electrode side against a surface tension of the liquid solution (refer to FIG. 14B).

Since the above-mentioned liquid jetting apparatus 50 jets a droplet by the nozzle 51 having minute diameter which cannot be found conventionally, the electric field is concentrated by the liquid solution in a charged state in the in-nozzle passage 52, and thereby the electric field intensity is enhanced. Therefore, jetting of the liquid solution by a nozzle having a minute diameter (for example, an inside diameter of 100 [μm], which was conventionally regarded as substantially impossible since a voltage necessary for jetting would become too high with a nozzle having a structure in which concentration of the electric field is not performed, is now possible with a lower voltage than the conventional one.

Then, since it is a minute diameter, it is possible to do the control to easily reduce jetting quantity per unit time due to low nozzle conductance, and the jetting of the liquid solution with a sufficiently-small droplet diameter (0.8 [μm] according to each above-mentioned condition) without narrowing a pulse width is realized.

Further, since the jetted droplet is charged, even though it is a minute droplet, a vapor pressure is reduced and evaporation is suppressed, and thereby the loss of mass of the droplet is reduced. Thus, the flying stabilization is achieved and the decrease of landing accuracy of the droplet is prevented.

Moreover, in the liquid jetting apparatus 50, the length of the in-nozzle passage is set to not less than 100 times of the inside diameter, so that the electric field can be concentrated more effectively, thereby responsiveness to the jetting of a droplet can be improved and a jetted droplet can be minute, and also the jetting position can be concentrated more stably.

Moreover, a wall thickness of the tube at the edge portion of the nozzle 51 is set to not more than the length equal to the inside diameter $D_I$, so that the outside diameter of the edge surface of the nozzle 51 can be not more than three times of the inside diameter. Thus, concentration of the jetting operation by the concentrated electric field can be effectively achieved at the meniscus edge portion by making the convex meniscus minute, thereby responsiveness can be improved and a droplet can be minute.

Further, since the water repellent coating 51*a* is formed on the edge surface of the surface of the nozzle 51, the convex meniscus corresponding to the inside diameter of the nozzle 51 can be formed. Thus, concentration of the jetting operation by the concentrated electric field can be achieved more effectively at the meniscus edge portion, thereby responsiveness can be improved and a droplet can be minute. In this case, the meaning of making the convex meniscus minute by thinning the wall thickness t of the nozzle 51 has small significance. However, even in this case, if the liquid solution spreads on the water repellent coating 51*a*, the spread can be within the range of the edge surface, thereby having an effect to maintain making the convex meniscus small in two steps.

(Other Nozzle)

Figure 15:
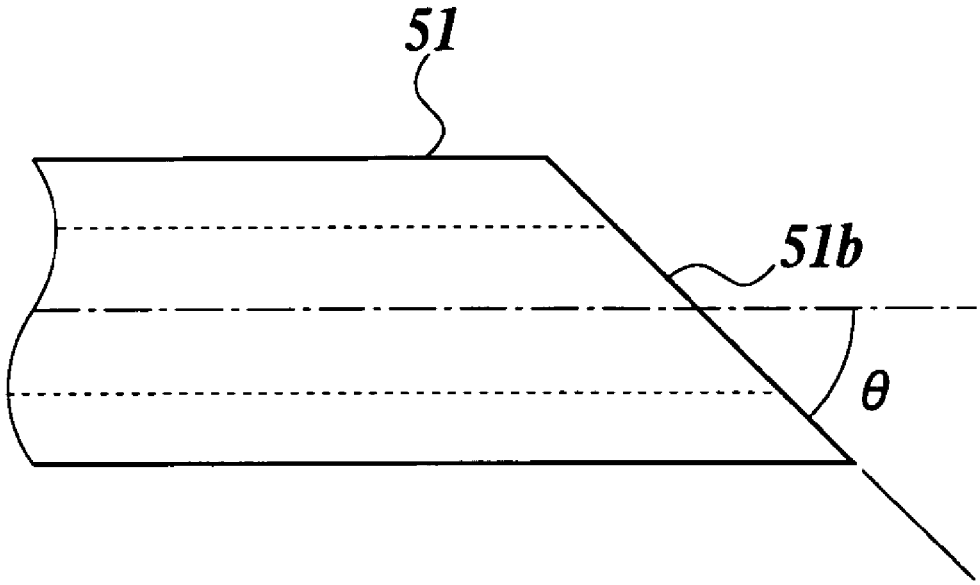
FIG. 15 is an explanation view of showing an example of other nozzle provided with an inclined surface at the edge.

Regarding to the edge shape of the nozzle 51, as shown in FIG. 15, the edge surface of the nozzle 51 may be an inclined surface 51*b* with respect to a centerline of the in-nozzle passage 52. An inclination angle θ of the edge surface 51*b* (the state where a normal line of the inclined surface 51*b* accords to the centerline of the in-nozzle passage is defined as 90 degrees) is preferably in a range of 30-45 [°], and here, it is set to 40 [°]. By making the edge surface of the nozzle 51 be the inclined surface 51*b* within the angle range as above, the liquid solution can be concentrated to the jetting edge portion side by the inclined surface 51*b* without undermining the effect of the electric field concentration by discharge. Thus, concentration of the jetting operation by the concentrated electric field can be achieved more effectively at the meniscus edge portion, thereby responsiveness can be improved and a droplet can be minute.

(Others)

For obtaining electro wetting effect to the nozzle 51, an electrode may be provided at a circumference of the nozzle 51, or an electrode may be provided at an inside surface of the in-nozzle passage 52 and an insulating film may cover over it. Then, by applying a voltage to this electrode, it is possible to enhance wettability of the inside surface of the in-nozzle passage 52 with respect to the liquid solution to which the voltage is applied by the jetting electrode 58 according to the electro wetting effect, and thereby it is possible to smoothly supply the liquid solution to the in-nozzle passage 52, resulting in preferably performing the jetting and improving responsiveness of the jetting.

[Comparative Study 1 of Nozzle]

The results of the comparative study which is performed with a liquid jetting apparatus approximately same as the above described liquid jetting apparatus 50 under the predetermined conditions by changing a size of each part of the nozzle will be explained below. FIG. 17 is a chart showing results of the comparative study. The comparative study was performed for eight kinds of subjects processed from glass material by femtosecond laser to make each value of $D_I$, $D_0$, $D_{max}$ and H, (refer to FIG. 12) at the upper surface (including the nozzle) of the nozzle plate be the following size.

No. 1

$D_I$=1 [μm], $D_0$=2 [μm], $D_{max}$=5 [μm], H=1 [μm]

No. 2

$D_I$=1 [μm], $D_0$=2 [μm], $D_{max}$=5 [μm], H=9 [μm]

No. 3

$D_I$=1 [μm], $D_0$=2 [μm], $D_{max}$=5 [μm], H=10 [μm]

No. 4

$D_I$=1 [μm], $D_0$=2 [μm], $D_{max}$=5 [μm], H=49 [μm]

No. 5

$D_I$=1 [μm], $D_0$=2 [μm], $D_{max}$=5 [μm], H=50 [μm]

No. 6

$D_I$=1 [μm], $D_0$=2 [μm], $D_{max}$=5 [μm], H=51 [μm]

No. 7

$D_I$=1 [μm], $D_0$=2 [μm], $D_{max}$=5 [μm], H=99 [μm]

No. 8

$D_I$=1 [μm], $D_0$=2 [μm], $D_{max}$=5 [μm], H=100 [μm]

The structure other than the above described conditions is same as the liquid jetting apparatus 50 shown in the first embodiment. That is, the nozzle with the inside diameter of the in-nozzle passage and the jetting opening of 1 [μm] is used.

Further, as the driving conditions, (1) a jetted droplet is sampled 100 times with frequency of the pulse voltage as a trigger for jetting of 1 [kHz], (2) the jetting voltage: the bias voltage is 300 [V] and the jetting pulse voltage is 100 [V], (3) distance from the nozzle edge to the counter electrode is 100 [μm], (4) the liquid solution is water, properties thereof are such that a viscosity: 8 [cP]($8\times10^{-2}$ [Pa/S]), a resistivity: $10^8$ [Ωcm] and a surface tension: $30\times10^{-3}$ [N/m], and (5) the base member is a glass plate.

Images are taken by a stereoscopic microscope and a digital camera under the above conditions, and minuteness and evenness are evaluated. The evaluation is performed on five scales, wherein five shows the best evenness.

According to the results, when the nozzle height H is 10 [μm] which is ten times of the inside diameter, a jetted droplet diameter was made minute to 1 [μm] equal to the nozzle inside diameter, and evenness was observed to be improved three scales.

Further, when the nozzle height H is 50 [μm] which is 50 times of the inside diameter, a jetted droplet diameter was made minute to 0.8 [μm] which is smaller than the nozzle inside diameter, and evenness was improved to four and remarkable reduction of unevenness was observed.

Further, when the nozzle height H is 100 [μm] which is 100 times of the inside diameter, evenness was improved to five and remarkable reduction of unevenness of dot diameter was observed.

[Comparative Study 2 of Nozzle]

The results of the comparative study which is performed with a liquid jetting apparatus approximately same as the above described liquid jetting apparatus 50 under the predetermined driving conditions by changing design condition of each part of the nozzle will be explained below. FIG. 18 is a chart showing results of a comparative study. The comparative study was performed for nine kinds of subjects. They are processed from glass material by femtosecond laser to make each value of $D_I$, t (refer to FIGS. 12) at the upper surface (including the nozzle) of the nozzle plate be the following size and make the inclination angle of the inclined surface of the nozzle edge be the angle shown below, and each of the subjects is formed to be one in which the water repellent coating is not formed, one in which the water repellent coating is formed as shown in FIG. 13A or one in which the water repellent coating is formed as shown in FIG. 13B No. 1

$D_I$=1 [μm], t=2 [μm], H=10 [μm], water repellent coating: unavailable, inclination angle 90 [°] (no inclination)

No. 2

$D_I$=1 [μm], t=1 [μm], H=10 [μm], water repellent coating: unavailable, inclination angle 90 [°] (no inclination)

No. 3

$D_I$=1 [μm], t=0.2 [μm], H=10 [μm], water repellent coating: unavailable, inclination angle 90 [°] (no inclination)

No. 4

$D_I$=1 [μm], t=1 [μm], H=10 [μm], water repellent coating: only on edge surface (FIG. 13A), inclination angle 90 [°] (no inclination)

No. 5

$D_I$=1 [μm], t=0.2 [μm], H=10 [μm], water repellent coating: edge surface+circumferential surface (FIG. 13B), inclination angle 90 [°] (no inclination)

No. 6

$D_I$=1 [μm], t=2 [μm], H=10 [μm], water repellent coating: edge surface+circumferential surface (FIG. 13B), inclination angle 90 [°] (no inclination)

No. 7

$D_I$=1 [μm], t=1 [μm], H=10 [μm], water repellent coating: edge surface+circumferential surface (FIG. 13B), inclination angle 40 [°]

No. 8

$D_I$=1 [μm], t=0.2 [μm], H=10 [μm], water repellent coating: edge surface+circumferential surface (FIG. 13B), inclination angle 40 [°] (no inclination)

No. 9

$D_I$=1 [μm], t=0.2 [μm], H=10 [μm], water repellent coating: edge surface+circumferential surface (FIG. 13B), inclination angle 20 [°] (no inclination)

The structure other than the above described conditions is same as the liquid jetting apparatus 50 shown in the first embodiment. That is, the nozzle with the inside diameter of the in-nozzle passage and the jetting opening of 1 [μm] is used.

Further, as the driving conditions, (1) a jetted droplet is sampled 100 times with frequency of the pulse voltage as a trigger for jetting of 1 [kHz], (2) the jetting voltage: the bias voltage is 300 [V] and the jetting pulse voltage is 100 [V], (3) distance from the nozzle edge to the counter electrode is 100 [μm], (4) the liquid solution is water, properties thereof are such that a viscosity: 8 [cP]($8\times10^{-2}$ [Pa/S]), a resistivity: $10^8$ [Ωcm] and a surface tension: $30\times10^{-3}$ [N/m], and (5) the base member is a glass plate.

Images are taken by a stereoscopic microscope and a digital camera under the above conditions, and minuteness and evenness are evaluated. The evaluation is performed on five scales with responsiveness evaluation one as a standard, wherein five shows the best responsiveness.

According to the results, compared to the No. 1 in which the wall thickness t of the nozzle edge portion is 2 [μm] which is larger than the inside diameter, when the wall thickness t of the nozzle edge portion is set to 1 [μm] which is equal to the inside diameter (No. 2), significantly improved responsiveness was observed. When the wall thickness t of the nozzle edge portion is set to 0.2 [μm] (No. 3) which is smaller than ¼ of the inside diameter, further improved responsiveness was observed.

Moreover, compared to the No. 2 in which the water repellent coating is not provided, when the water repellent coating is provided only on the nozzle edge surface (No. 4), improved responsiveness was observed.

Further, compared to the No. 3 in which the water repellent coating is not provided, when the water repellent coating is provided on the nozzle edge surface and the circumferential surface (No. 5), significantly improved responsiveness was observed.

Moreover, compared to the No. 5 in which the inclination angle of the inclined surface at the nozzle edge surface is 90 [°] (no inclination), when the inclination angle of the inclined surface at the nozzle edge surface is 40 [°] (No. 8), the most favorable and remarkably improved responsiveness was observed.

On the other hand, compared to the No. 5 in which the inclined surface is not provided, when the inclination angle of the inclined surface at the nozzle edge surface is 20 [°] (No. 9), decrease of responsiveness was observed. This is because the smaller the inclination angle is (the edge has more acute angle), discharge tends to occur easily, so that it is considered that this effect occurred.

[Theoretical Description of Liquid Jetting by Liquid Jetting Apparatus]

Hereinafter, a theoretical description of liquid jetting of the present invention and a description of a basic example based on this will be made. In addition, all the contents such as a nozzle structure, material of each part and properties of jetted liquid, a structure added around the nozzle, a control condition regarding a jetting operation and the like in the theory and the basic example described hereafter may be, needless to say, applied in each of the above-mentioned embodiments as much as possible.

(Approach to Realize Applying Voltage Decrease and Stable Jetting of Minute Droplet Amount)

Previously, jetting of a droplet with exceeding a range determined by the following conditional equation was considered impossible.

$$d < \frac{\lambda_c}{2} \tag{4}$$

where, $\lambda_c$ is growth wavelength [m] at liquid level of the liquid solution for making it possible to jet a droplet from the nozzle edge portion by an electrostatic sucking force, and it can be calculated by $$\lambda_c = 2\pi\gamma h^2/\epsilon_0 V^2.$$

$$d < \frac{\pi\gamma h^2}{\varepsilon_0 V^2} \tag{5}$$

$$V < h\sqrt{\frac{\pi\gamma}{\varepsilon_0 d}} \tag{6}$$

In the present invention, a role in an electrostatic sucking type inkjet method played by the nozzle is reconsidered, in an area where attempt was not made since it was conventionally regarded as impossible to jet, it is possible to form a minute droplet by using a Maxwell force or the like.

An equation for approximately expressing a jetting condition or the like for the approach to reduce a driving voltage and to realize jetting of minute droplet amount in this way is derived and therefore described hereafter.

Descriptions hereafter can be applied to the liquid jetting apparatus described in each of the above-mentioned embodiments of the present invention.

Figure 19:
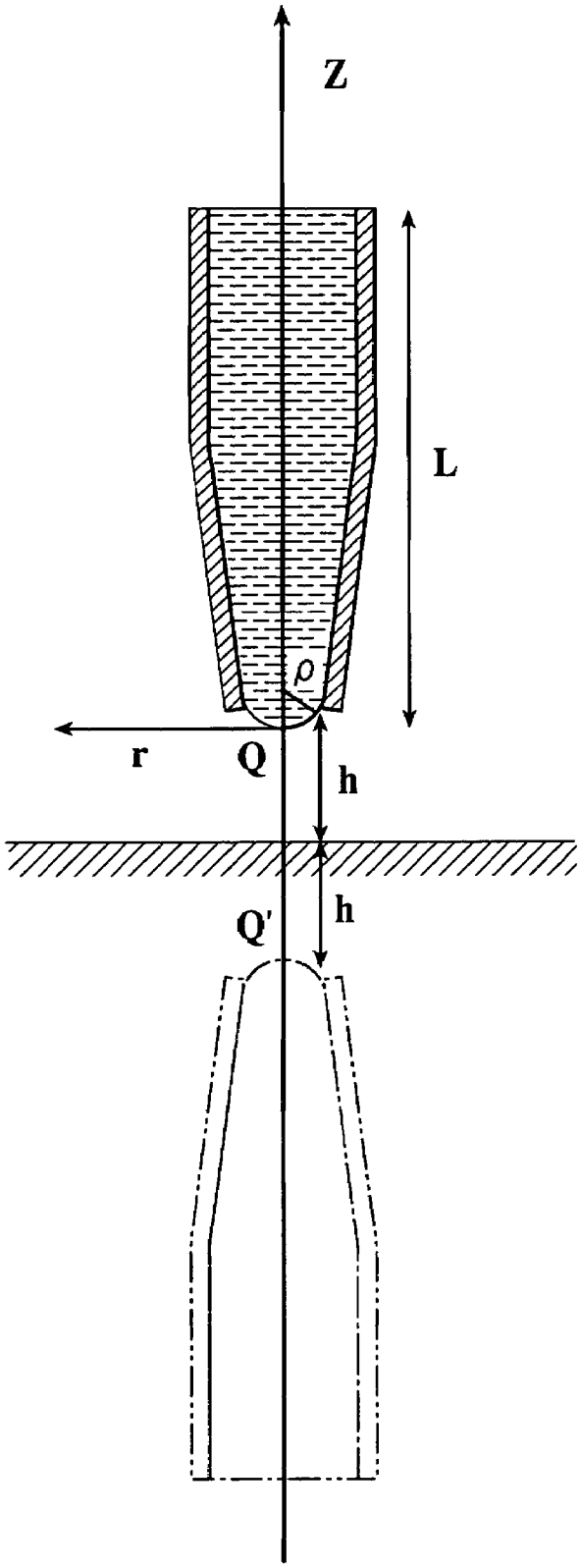
FIG. 19 is a view for describing a calculation of the electric field intensity of the nozzle of the embodiments of the present invention.

Assuming that conductive liquid solution is filled to a nozzle of an inside diameter d and the nozzle is perpendicularly placed with a height h with respect to an infinite plane conductor as a base material at this moment. This state is shown in FIG. 19. At this time, it is assumed that electric charge induced at the nozzle edge portion is concentrated to a hemisphere portion of the nozzle edge, and is approximately expressed in the following equation.

$$Q = 2\pi\epsilon_0 \alpha V d \tag{7}$$

where, Q: electric charge induced at the nozzle edge portion [C], $\epsilon_0$: electric constant [F/m], h: distance between nozzle and base material [m], d: diameter of inside of the nozzle [m], and V: total voltage applied to the nozzle [V]. α: proportionality constant dependent on a nozzle shape or the like, taking around 1 to 1.5, especially takes approximately 1 when d<<h.

Further, when the base plate as the base material is a conductive base plate, it is considered that an image charge Q' having opposite sign is induced to the symmetrical position in the base plate. When the base plate is insulating material, similarly an image charge Q' of opposite sign is induced to the symmetrical position determined by a conductivity.

By the way, electric field intensity $E_{loc}$ [V/m] of the edge portion of convex meniscus at the nozzle edge portion is, when a curvature radius of the convex meniscus is assumed to be R [m], given as $$E_{loc} = \frac{V}{kR} \tag{8}$$

where, k: proportionality constant, though being different depending on a nozzle shape or the like, taking around 1.5 to 8.5, and in most cases considered approximately 5 (P. J. Birdseye and D. A. Smith, Surface Science, 23 (1970) 198-210).

Now, for ease, we assume d/2=R. This corresponds to a state where the conductive liquid solution rises in a hemisphere shape having the same radius as the nozzle radius according to a surface tension force.

We consider a balance of pressure affecting liquid of the nozzle edge. First, when a liquid area at the nozzle edge portion is assumed to be S [$m^2$], electrostatic pressure is given as $$P_e = \frac{Q}{S} E_{loc} \approx \frac{Q}{\pi d^2/2} E_{loc} \tag{9}$$

From the equations (7), (8) and (9), it is assumed that $\alpha=1$, $$P_e = \frac{2\varepsilon_0 V}{d/2} \cdot \frac{V}{k \cdot d/2} = \frac{8\varepsilon_0 V^2}{k \cdot d^2} \tag{10}$$

Meanwhile, when a surface tension of the liquid at the nozzle edge portion is $P_s$, $$P_s = \frac{4\gamma}{d} \tag{11}$$

where, $\lambda$: surface tension [N/m].

A condition under which jetting of fluid occurs is, since it is a condition where the electrostatic pressure exceeds the surface tension, given as $$P_e > P_s \tag{12}$$

By using a sufficiently-small nozzle diameter d, it is possible to make the electrostatic pressure exceed the surface tension.

According to this relational equation, when a relation between V and d is calculated, $$V > \sqrt{\frac{\gamma k d}{2\varepsilon_0}} \tag{13}$$

gives the minimum voltage of jetting. In other words, from the equation (6) and the equation (13), $$h\sqrt{\frac{\gamma\pi}{\varepsilon_0 d}} > V > \sqrt{\frac{\gamma k d}{2\varepsilon_0}} \tag{1}$$

becomes an operation voltage in the present invention.

Dependency of a jetting limit voltage $V_c$ with respect to a nozzle of a certain inside diameter d is shown in the above-mentioned FIG. 19. From this drawing, when a concentration effect of the electric field by the minute nozzle is considered, the fact that the jetting start voltage decreases according to the decrease of the nozzle diameter was revealed.

In a case of making a conventional consideration with respect to the electric field, that is, considering only the electric field which is defined by a voltage applied to a nozzle and by a distance between counter electrodes, as the nozzle becomes smaller, a voltage necessary for jetting increases. On the other hand, focusing on local electric field intensity, due to nozzle miniaturization, it is possible to decrease the jetting voltage.

The jetting according to electrostatic sucking is based on charging of liquid (liquid solution) at the nozzle edge portion. Speed of the charging is considered to be approximately around time constant determined by dielectric relaxation.

$$\tau = \frac{\varepsilon}{\sigma} \tag{2}$$

where, $\in$: dielectric constant of liquid solution [F/m], and $\sigma$: liquid solution conductivity [S/m]. When it is assumed that dielectric constant of the liquid solution is 10 F/m, and liquid solution conductivity is $10^{-6}$ S/m, $\tau=1.854\times10^{-6}$ sec is obtained. Alternatively, when a critical frequency is set to $f_c$ [Hz], $$f_c = \frac{\sigma}{\varepsilon} \tag{14}$$

is obtained. It is considered that jetting is impossible because it is not possible to react to the change of the electric field having faster frequency than this $f_c$. When estimation regarding the above-mentioned example is made, the frequency takes around 10 kHz. At this time, in a case of a nozzle radius of 2 μm and a voltage of a little under 500V, it is possible to estimate that current in the nozzle G is $10^{-13}$ $m^3/s$. In a case of the liquid of the above-mentioned example, since it is possible to perform the jetting at 10 kHz, it is possible to achieve minimum jetting amount at one cycle of around 10 fl (femto liter, 1 fl=$10^{-16}$ l).

Figure 20:
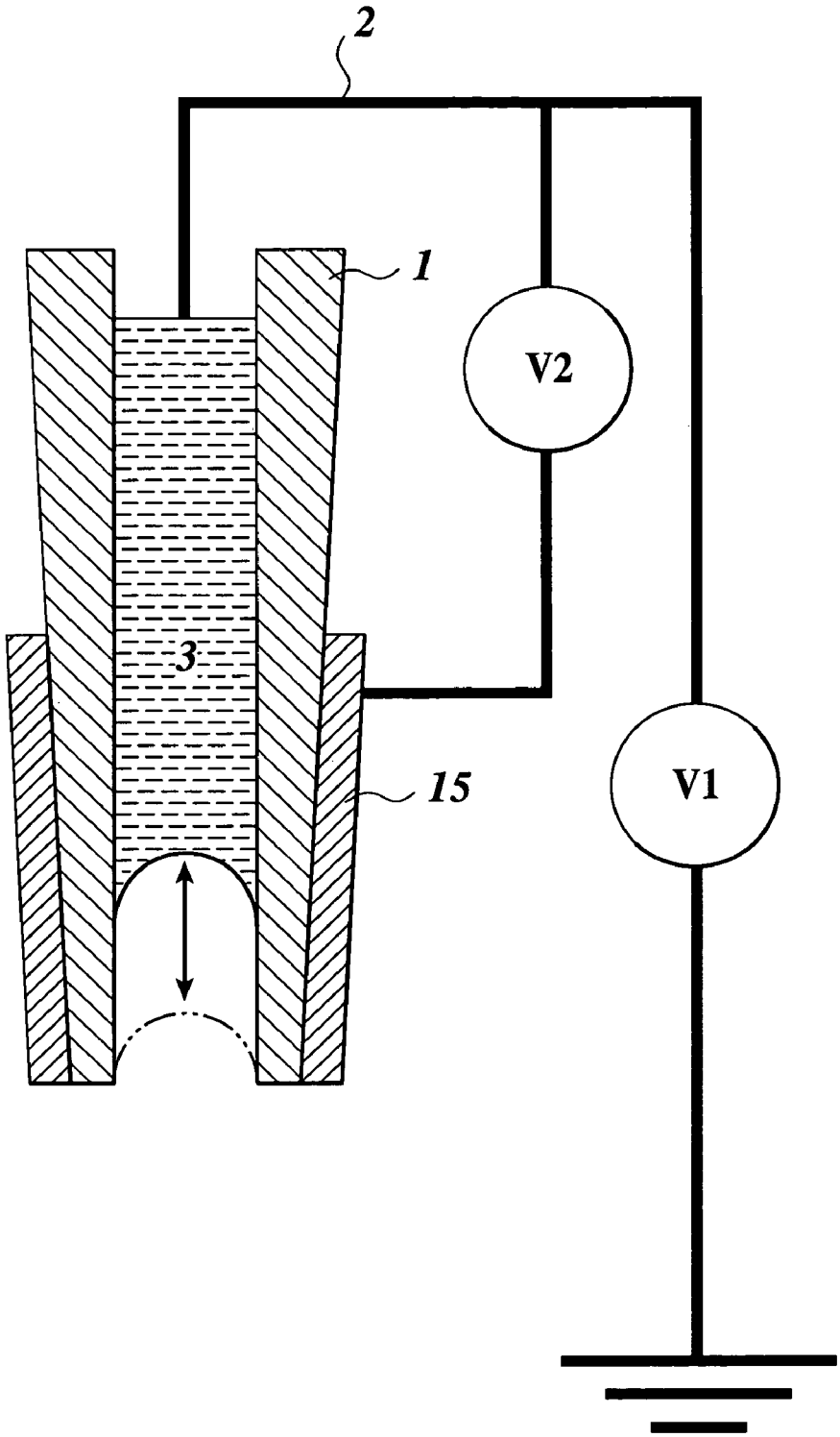
FIG. 20 is a side sectional view of the liquid jetting apparatus as one example of the present invention.

In addition, each of the above-mentioned embodiments, as shown in FIG. 20, is characterized by a concentration effect of the electric field at the nozzle edge portion and by an act of an image force induced to the counter base plate. Therefore, it is not necessary to have the base plate or a base plate supporting member electrically conductive as conventionally, or to apply a voltage to these base plate or base plate supporting member. In other words, as the base plate, it is possible to use a glass base plate being electrically insulated, a plastic base plate such as polyimide, a ceramics base plate, a semiconductor base plate or the like.

Further, in each of the above-mentioned embodiments, the applying voltage to an electrode may be any of plus or minus.

Further, by maintaining a distance between the nozzle and the base plate not more than 500 [μm], it is possible to make the jetting of the liquid solution easy. Further, preferably, the nozzle is maintained constant with respect to the base material by doing a feedback control according to a nozzle position detection.

Further, the base material may be mounted on a base material holder being either electrically conductive or insulated to be maintained.

FIG. 20 shows a side sectional view of a nozzle part of the liquid jetting apparatus as one example of another basic example of the present invention. At a side-surface portion of a nozzle 1, an electrode 15 is provided, and a controlled voltage is applied between the electrode 15 and an in-nozzle liquid solution 3. The purpose of this electrode 15 is an electrode for controlling Electrowetting effect. When a sufficient electric field covers an insulator structuring the nozzle, it is expected that the Electrowetting effect occurs even without this electrode. However, in the present basic example, by doing the control using this electrode more actively, a role of a jetting control is also achieved. In the case that the nozzle 1 is structured from insulator, a nozzle tube at the nozzle edge portion is 1 μm, a nozzle inside diameter is 2 μm and an applying voltage is 300V, it becomes Electrowetting effect of approximately 30 atmospheres. This pressure is insufficient for jetting but has a meaning in view of supplying the liquid solution to the nozzle edge portion, and it is considered that control of jetting is possible by this control electrode.

The above-mentioned FIG. 9 shows dependency of the nozzle diameter of the jetting start voltage in the present invention. As the nozzle of the liquid jetting apparatus, one which is shown in FIG. 11 is used. As the nozzle becomes smaller, the jetting start voltage decreases, and the fact that it was possible to perform jetting at a lower voltage than conventionally was revealed.

In each of the above-mentioned embodiments, conditions for jetting the liquid solution are respective functions of: a distance between nozzle and base material (h); an amplitude of applying voltage (V); and an applying voltage frequency (f), and it is necessary to satisfy certain conditions respectively as the jetting conditions. Adversely, when any one of the conditions is not satisfied, it is necessary to change another parameter.

Figure 21:
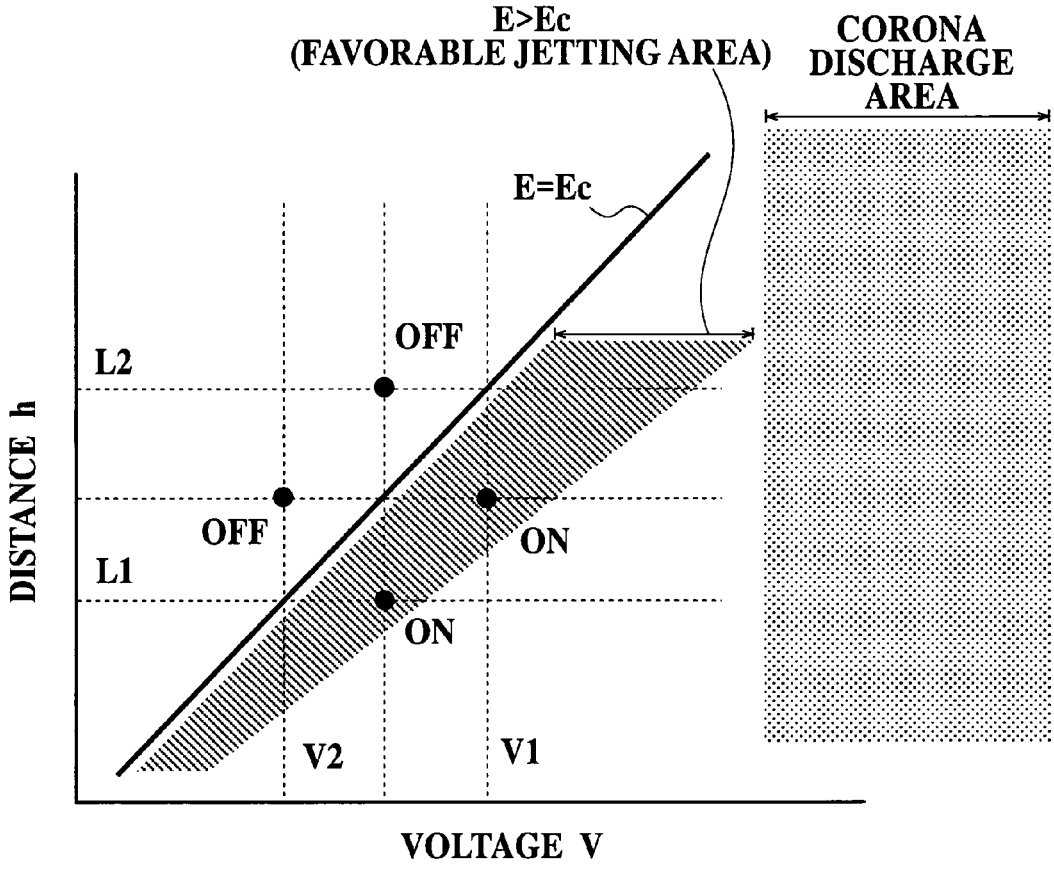
FIG. 21 is a view for describing a jetting condition according to a relation of distance-voltage in the liquid jetting apparatus of the embodiments of the present invention.

This state will be described with reference to FIG. 21.

First, for jetting, a certain critical electric field $E_c$ exists, where jetting is not performed unless the electric field is not less than the electric field $E_c$. This critical electric field is a value changed according to the nozzle diameter, a surface tension of the liquid solution, viscosity or the like, and it is difficult to perform the jetting when the value is not more than $E_c$. At not less than the critical electric field $E_c$, that is, at jetting capable electric field intensity, approximately a proportional relation arises between the distance between nozzle and base material (h) and the amplitude of applying voltage (V), and when the distance between nozzle and base material is shortened, it is possible to make the critical applying voltage V smaller.

Adversely, when the distance between nozzle and base material h is made extremely apart for making the applying voltage V larger, even if the same electric field intensity is maintained, according to an effect such as corona discharge or the like, blowout of fluid droplet, that is, burst occurs.

INDUSTRIAL APPLICABILITY

As described above, the present invention is suitable to jet a droplet for each usage of normal printing as graphic use, printing to special medium (film, fabric, steel plate), curved surface printing, and the like, or patterning coating of wiring, antenna or the like by liquid or paste conductive material, coating of adhesive, sealer and the like for processing use, for biotechnological, medical use, pharmaceuticals (such as one mixing a plurality of small amount of components), coating of sample for gene diagnosis or the like.

The invention claimed is:

1. A liquid jetting apparatus to jet a droplet of a charged liquid solution onto a base material, comprising:

a liquid jetting head comprising a nozzle to jet the droplet from an edge portion, an inside diameter of the edge portion of the nozzle being more than 0.2 μm and being not more than 4 μm, and at least the edge portion of the nozzle being formed with insulating material, the nozzle being integrally formed with a nozzle plate;

a liquid solution supplying section to supply the liquid solution into the nozzle; and a jetting voltage applying section to apply a jetting voltage to the liquid solution in the nozzle, the jetting voltage applying section comprising a jetting electrode provided as a layer on a back end surface of the nozzle plate, the jetting electrode having an ink passage hole positioned at a border between the liquid solution supplying section and the inside passage;

wherein an inside passage length of the nozzle is set to at least not less than 50 times of the inside diameter of the nozzle at the nozzle edge portion.

2. The liquid jetting apparatus of claim 1, wherein the inside passage length of the nozzle is set to at least not less than 100 times of the inside diameter of the nozzle at the nozzle edge portion.

3. The liquid jetting apparatus of claim 1, wherein a wall thickness of the nozzle at the nozzle edge portion is set to not more than a length equal to the inside diameter of the nozzle at the edge portion of the nozzle.

4. The liquid jetting apparatus of claim 3, wherein the wall thickness of the nozzle at the edge portion of the nozzle is set to not more than ¼ of the length equal to the inside diameter of the nozzle at the nozzle edge portion.

5. The liquid jetting apparatus of claim 1, wherein at least the edge portion of a surface of the nozzle is subjected to a water repellent processing.

6. The liquid jetting apparatus of claim 1, wherein an edge surface of the nozzle comprises an inclined surface with respect to a centerline of the in-nozzle passage.

7. The liquid jetting apparatus of claim 6, wherein an inclination angle of the edge surface of the nozzle is set to be in a range of 30 to 45 degrees (when a state m which a normal line of the inclined surface is parallel to the centerline of the in-nozzle passage is defined as 90 degrees).

8. The liquid jetting apparatus of claim 1, wherein a jetting electrode of the jetting voltage applying section is provided on a back end portion side of the nozzle.

9. The liquid jetting apparatus of claim 1, wherein the liquid solution supplying section comprises a liquid solution room, and the ink passage hole is at a border position between the liquid solution room and the inside passage of the nozzle.

10. The liquid jetting apparatus of claim 1, wherein the inside diameter of the nozzle at the nozzle edge portion and an inside diameter of the inside passage of the nozzle are uniform.

* * * * *

UNITED STATES PATENT AND TRADEMARK OFFICE

CERTIFICATE OF CORRECTION

PATENT NO. : 7,337,987 B2
APPLICATION NO. : 10/529004
DATED : March 4, 2008
INVENTOR(S) : Nishi et al.

It is certified that error appears in the above-identified patent and that said Letters Patent is hereby corrected as shown below:

Title Page;

Item (54), Title of Invention, delete "LIQUID JETTING DEVICE" and insert therefor --LIQUID JETTING APPARATUS--.

Item (73), Assignee, delete "Konica Minolta Holdings, Inc. (JP)" and insert therefor --Konica Minolta Holdings, Inc. (JP); Sharp Kabushiki Kaisha (JP); National Institute of Advanced Industrial Science and Technology (JP)--.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,337,987 B2
APPLICATION NO. : 10/529004
DATED : March 4, 2008
INVENTOR(S) : Nishi et al.

It is certified that error appears in the above-identified patent and that said Letters Patent is hereby corrected as shown below:

Title Page, Item (54) and at Column 1, line 1, Title of Invention, delete "LIQUID JETTING DEVICE" and insert therefor --LIQUID JETTING APPARATUS--.

Title Page, Item (73), Assignee, delete "Konica Minolta Holdings, Inc. (JP)" and insert therefor --Konica Minolta Holdings, Inc. (JP); Sharp Kabushiki Kaisha (JP); National Institute of Advanced Industrial Science and Technology (JP)--.

This certificate supersedes the Certificate of Correction issued March 30, 2010.

Signed and Sealed this

Twentieth Day of April, 2010

David J. Kappos

David J. Kappos
*Director of the United States Patent and Trademark Office*